US006527067B1

(12) United States Patent
Ravensbergen et al.

(10) Patent No.: US 6,527,067 B1
(45) Date of Patent: Mar. 4, 2003

(54) LATERAL ENTRY GUIDANCE SYSTEM (LEGS)

(75) Inventors: John E. Ravensbergen, Calgary (CA); Mitchell D. Lambert, Calgary (CA)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 09/630,828

(22) Filed: Aug. 2, 2000

Related U.S. Application Data

(60) Provisional application No. 60/147,102, filed on Aug. 4, 1999.

(51) Int. Cl.[7] ..... E21B 7/06

(52) U.S. Cl. ..... 175/381; 175/61; 175/73

(58) Field of Search ..... 175/61, 73, 38, 175/215, 381, 74, 77; 166/250.01, 253.1, 50

(56) References Cited

U.S. PATENT DOCUMENTS

| | | | | |
|---|---|---|---|---|
| 4,880,067 A | | 11/1989 | Jelsma | 175/107 |
| 5,394,951 A | * | 3/1995 | Pringle et al. | 175/61 |
| 5,738,178 A | * | 4/1998 | Williams et al. | 175/61 |
| 5,857,531 A | * | 1/1999 | Estep et al. | 175/75 |
| 6,053,254 A | | 4/2000 | Gano | |
| 6,109,370 A | * | 8/2000 | Gray | 175/61 |

FOREIGN PATENT DOCUMENTS

| | | | | |
|---|---|---|---|---|
| GB | 2026063 A | | 1/1980 | E21B/7/08 |
| GB | 2234278 A | | 1/1991 | E21B/7/08 |
| GB | 2288836 A | * | 11/1995 | |
| GB | 2316427 A | | 2/1998 | E21B/7/08 |

OTHER PUBLICATIONS

M. Lambert, BJ Services Ltd., Multilateral Well Leg Re–Entry Made Possible With a Unique Coiled Tubing Downhole Tool, SPE 60702.

"Tomorrow's Downhole Intervention Solutions For Today's Problems", PCE Product Review; Issue No. 3 Winter 99/2000.

Pressure Control Engineering, Coiled Tubing Technology, pp. 64, 67, 68 & 104.

* cited by examiner

*Primary Examiner*—Frank S. Tsay
(74) *Attorney, Agent, or Firm*—Howrey Simon Arnold & White, LLP

(57) ABSTRACT

Method and apparatus for running tubing into a lateral bore of a multilateral well, including a bottom hole assembly having at least one remotely activatable, radially deflectable toe, and preferably method and apparatus to laterally sweep the toe, signal when the toe fully kicks out and follow the toe into a lateral bore.

73 Claims, 13 Drawing Sheets

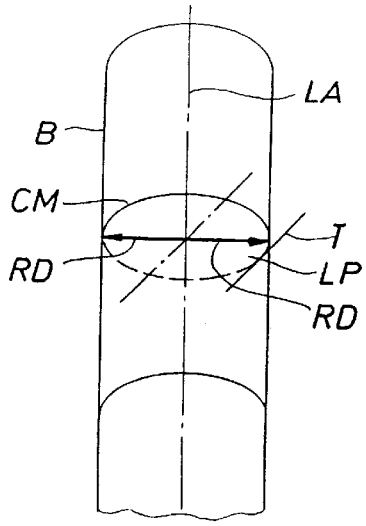
FIG. 1
FIG. 2
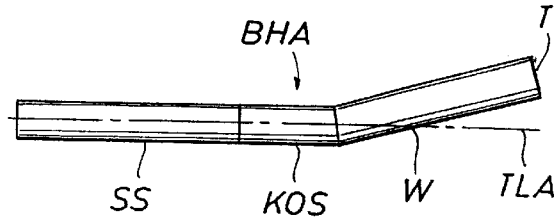
FIG. 3
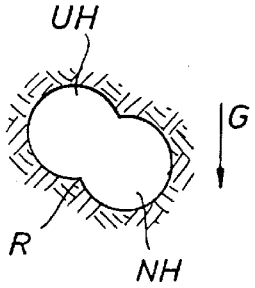
FIG. 4
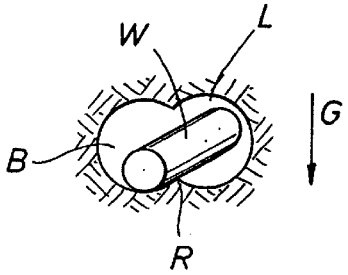
FIG. 5A
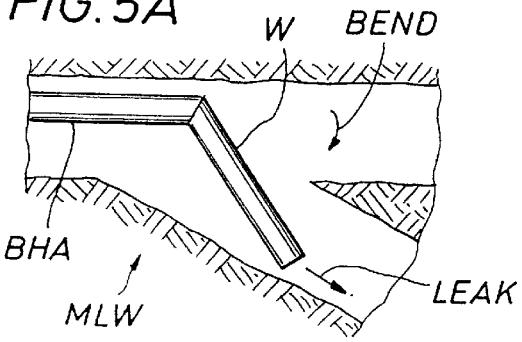
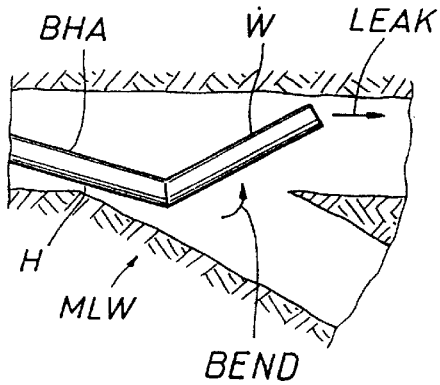
FIG. 5B
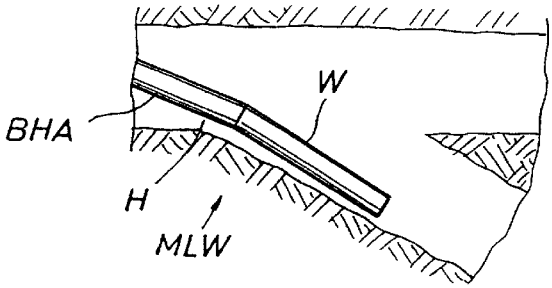
FIG. 5C FIG. 8A
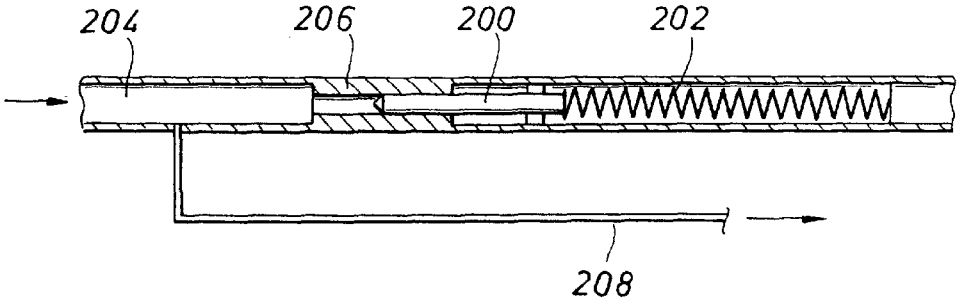
FIG. 8B
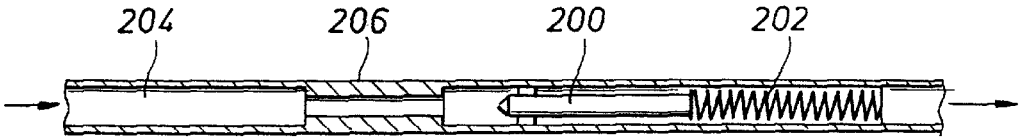
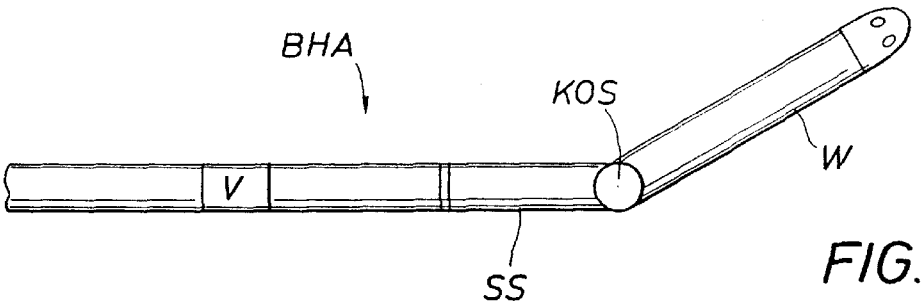
FIG. 9
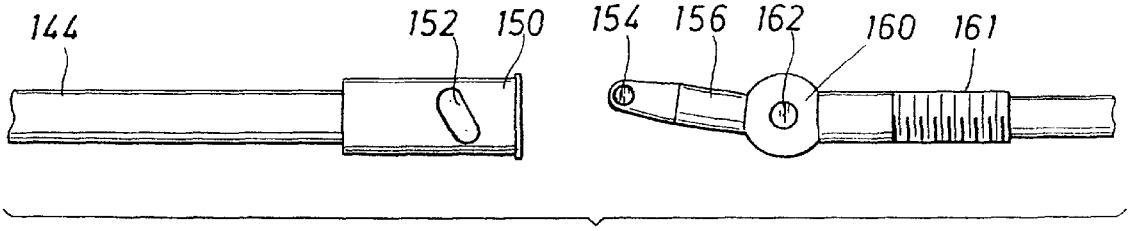
FIG. 10

FIG.11D-1
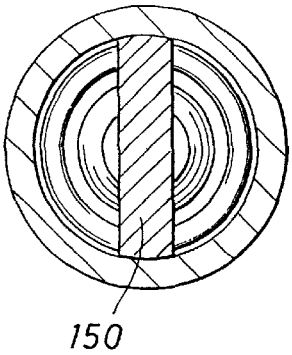
FIG.11D-2
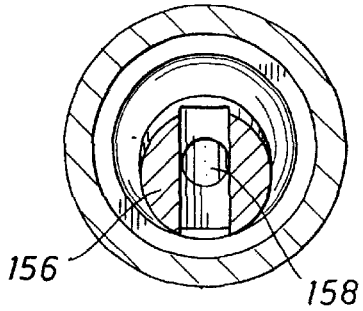
FIG.11D-3
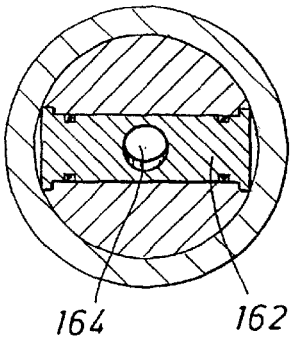
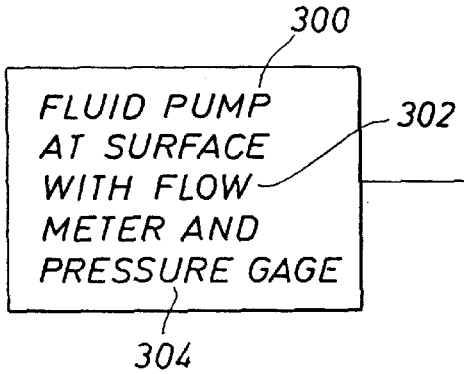
FIG.12A
FIG.12B
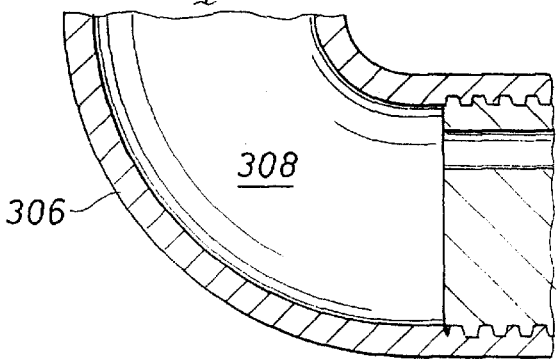
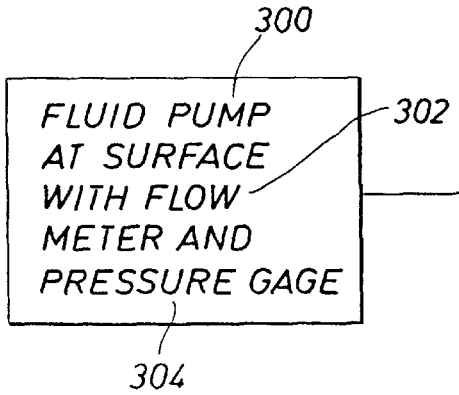
FIG.12AA
FIG.12BB
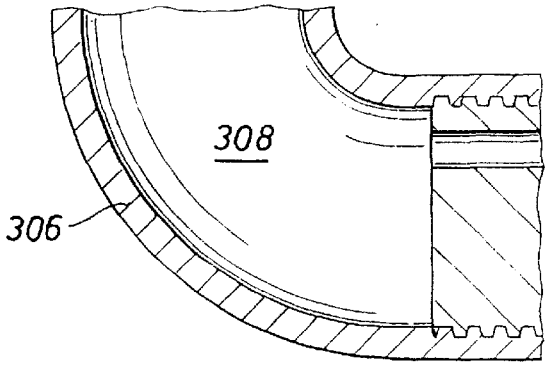

LATERAL ENTRY GUIDANCE SYSTEM (LEGS)

This application is based on the provisional application Ser. No. 60/147,102, filed Aug. 4, 1999 for "Lateral Entry Guidance System."

FIELD OF THE INVENTION

The invention relates to apparatus and method for running tubing into a bore of a multilateral well, including apparatus and method to run into a lateral bore not favored by gravity.

BACKGROUND OF THE INVENTION

Horizontal wells are now numerous in the oil patch, driven by the benefits gained from having a larger reservoir exposure, the wells running maybe thousands of feet through the producing reservoir rather than simply passing through its top to bottom, exposing tens of feet. An extension of this technique is to drill multilateral wells where several horizontal, or at least directional, drain holes are drilled from a single surface hole. This technique can be used to gain an even greater reservoir exposure from a single surface hole, or to gain greater access to different reservoirs altogether from the same well.

Drilling multilateral wells has a cost advantage during drilling, as only a single surface hole need be drilled, cased and cemented. In cases where wellhead space is limited, such as in offshore applications, the advantages of multilateral wells are compounded further.

There is a downside, however, which can offset the potential cost savings associated with drilling of multilateral wells. Subsequent workover operations requiring re-entry into specific branches of the multilateral well can be difficult. If a simple string of tubing is run into the well, there is really no control, absent special methods and apparatus, over which branch the tubing enters. The general problem becomes one of steering a workover string into the desired branch.

There are several existing methods available which attempt to overcome the above problem. Jointed pipe rigs are known to achieve selective re-entry by putting a bend on the end of a tubing string. The tubing is run in, tracking the direction of the bend in the tubing in the process (to the extent of the accuracy possible) and directing the bend by rotating the tubing at the surface towards the best estimate of the location and direction of the desired branch. (This process can be further complicated if several junctions have to be navigated through to reach the desired final branch.) The workover tubing is run to the bottom of the particular branch it is in and the running depth correlated to the well files to determine if in fact the tubing is in the desired branch. If the tubing is not in the desired branch, the tubing is pulled back up, past the best estimate of the location of the junction, rotated again and then the whole process is repeated. This can be a time-consuming process.

Another method used is to run special jewelry in the casing at the junction points. Profiles in this jewelry allow mating diverters or whipstocks to be landed adjacent to the junction, thereby forcing any subsequent tubing or tooling run into the well into the desired branch. This method can only be used, however, if the well bore is cased at the junction. It cannot be used if it is an older well that is being re-entered to construct the new laterals, as the casing jewelry cannot typically be added after the primary casing is cemented in place. And installing the jewelry adds cost.

Coiled tubing is often a much better medium than jointed pipe for workover operations as it is quicker to use and much better suited to live well operations. An improved method and apparatus that permits coiled tubing to selectively enter different branches of a multilateral well is desirable. The bent sub method listed above cannot be used per se with coiled tubing. First, it is not possible to rotate the coiled tubing at the surface to align a bent end of the pipe to an estimated lateral. Second, there is no way of referencing which way a bent sub end is pointing by simply tracking the orientation of coiled tubing as it is run in the hole as coiled tubing, unlike jointed pipe, twists substantially downhole as it is run in a well.

Methods that attempt to address the need to run coiled tubing into selected bores using existing tooling place a rotational tool at the bottom of the coil, with a bent sub or the like beneath it. The tubing is first run in a well and enters one branch according to the chance orientation of the bent sub when the tooling reaches a junction. By tagging the bottom of the branch, the specific branch entered can be identified. If the wrong branch has been accessed, the tool is pulled back up to an estimated window location, the bent sub is rotated relative to the coiled tubing by the rotational tool, and the process repeated. Trial and error should eventually lead to the successful penetration of the desired lateral. This, however, can also be very time-consuming.

The instant invention enhances the above methodology by preferably offering a resettable element (or elements) that first detects and then leads into a lateral, the element sometimes referred to as a wand or a toe. Given the resettable option, for an initial advantage, tooling can be run in the hole through production tubing in a straight configuration, preventing possible hang-ups in the well. There is then the option of seeing which branch a tubing string naturally enters with no bend on the tooling. This could be beneficial, for instance, if a desired branch exits a main well bore from the bottom, as gravity may well take the straight tool and tubing naturally into that branch.

Further aspects of novel features of the present invention are an ability of the tool to set at least one wand or toe to sweep and detect a junction, and preferably to signal to an operator at the surface that a junction has been detected. Biasing a set wand or toe outward with an appropriate force can facilitate entering "unnatural" branches, or branches not favored by gravity. Signaling the surface operator upon the detection of a junction, when put together with prior information as to the expected location of lateral branches, can enhance the efficiency of selecting a desired branch and entering it, thereby alleviating the trial and error procedure previously practiced. The methodology makes possible a progression from try and see to control and feedback.

A novel aspect of the instant invention is a remotely activatable, radially deflectable, biasable toe. In simplified terms, the deflected toe can be viewed as an adjustable or active bent sub and/or a deflectable wand. The moment of force radially deflecting the toe biases the toe outwardly, against bore hole wall portions, creating a biasing force between the toe and BHA. At least within predetermined ranges, as the lateral distance between the BHA and a bull nose portion varies, the biasing force will vary the lateral distance between the toe and the BHA.

A "detect and signal" tool could also be run with electronic devices. E.g., the above tool could be run in conjunction with an electronic tool that senses the direction the tool is pointing (tool face relative to gravity or relative to north). An operator at the surface could independently infer which branch the tool is in. Other detection devices might be used that sense properties that could differentiate lateral branches.

This extra tooling could remove any need to tag the bottom of a lateral to confirm the branch entered, as by instead correlating the directions of the tool or other properties with the directions or other properties of various lateral branches at a given depth. However, the basic tool may be sufficiently accurate in practice, or tagging bottom may be sufficiently inexpensive, as not to require or justify the expense of these extra electronic devices.

The inventive tool and method herein is envisioned to be able to be used in combination with all manner of coiled tubing operations, such as stimulation, logging,jetting, cleaning and perforating.

In general, while a tool to navigate into multilateral wells is not per se new, detecting lateral junctions, signaling the surface that a junction is detected, using a junction profile and/or the earth's gravitational field to help control the actions of a tool and enhance its efficiency, to name just three points, are believed to be new.

SUMMARY OF THE INVENTION

The invention relates to apparatus and method for running tubing into a bore of a multilateral well. The method and apparatus are designed, in particular, to locate and run into an "unnatural" bore of a multilateral well, e.g., a bore not favored by gravity. The apparatus and method, although not limited to, are suitable for and are particularly effective for running on coiled tubing.

The apparatus includes a bottom hole assembly (BHA) having at least one remotely activatable, radially deflectable toe. In preferred embodiments, the BHA can be said to have at least one remotely activatable, radially deflectable wand. In preferred embodiments herein, a wand carries a toe. Further, in preferred embodiments, at least one toe or at least one wand, or the combination, is laterally adjustable.

The BHA is structured in combination with at least one toe or at least one wand to produce a moment of force in a radial direction. The moment of force in the radial direction deflects at least one wand and/or toe outwardly from a bore hole longitudinal axis and eccentrically biases the toe against a bore hole wall portion, at least for a predetermined lateral range. The moment of force created in the radial direction should be of an amount at least sufficient to lift at least one toe or one wand vertically against gravity, for up to a predetermined distance. In preferred embodiments, the moment of force in the radial direction is further of an amount insufficient to lift the BHA vertically against gravity or to significantly laterally adjust the BHA.

Also, in preferred embodiments, the BHA is structured to produce a moment of force in the lateral direction, sufficient to laterally adjust at least one deflected toe or wand. Further, a port is preferably structured in combination with the BHA and the at least one wand or toe such that the port adjusts BHA fluid pressure when the wand or toe is deflected beyond a predetermined amount. In preferred embodiments, the BHA is in fluid communication through coiled tubing with the well surface, and the toe or wand and the BHA are hydraulically activated. Adjustments in fluid pressure in the BHA are preferably detectable at the surface, as a signal.

The same toe or sub may be used to detect a lateral junction and to lead a BHA and tubing into the lateral (including into an "unnatural" bore hole.) However, a plurality of toes or wands might be used, with specialized functions. E.g., one or more toes or wands might be used to detect a lateral junction wherein a second toe or wand might be used to lead the BHA and tubing through the lateral junction. An economy of structure is achieved by the preferred embodiment illustrated in detail herein, using just one wand conveying one toe. It is to be understood, however, that the invention is not to be limited to the initial embodiment constructed and tested and described below.

In an alternate design, a toe or wand could be adjustable in length such that it has a first length for a detecting step and a second length for a leading step. There may be an efficiency advantage for using different lengths in different functions, and/or an adjustable length wand eliminates the need to refigure a wand length for different well bores.

The methodology for running tubing into a bore of a multilateral well includes running tubing, preferably coiled tubing, carrying a BHA into a multilateral well, radially deflecting at least one toe of the BHA to establish biased contact with a bore hole wall, moving the at least one toe in contact with bore hole wall portions and eccentrically kicking out the at least one toe. The method preferably includes sweeping, and preferably laterally adjusting, a deflected toe. In one preferred embodiment the method includes radially biasing a toe such that the toe "fully" deflects only when directed toward an enlarged bore hole space located at least in part vertically above the BHA. In one preferred embodiment the method includes adjusting pressurized fluid of the BHA when a toe deflects more than a predetermined amount. In one preferred embodiment the method includes running a tool on the tubing down a well proximate an estimated lateral junction, radially deflecting at least one toe, moving the at least one toe in contact with bore hole wall portions, deflecting at least one toe beyond a predetermined amount, deflecting a wand in a radial direction assumed by a toe deflected beyond a predetermined amount, and running the tool down behind a deflected wand into a lateral bore. In the latter methodology, the toe may be carried on the wand and the step of deflecting the toe may perform the step of deflecting the wand at the same time.

BRIEF DESCRIPTION OF THE DRAWINGS

A better understanding of the present invention can be obtained when the following detailed description of the preferred embodiment is considered in conjunction with the following drawings, in which:

FIG. 1 illustrates the terms lateral and radial direction within a bore hole, as the terms are used herein, for clarity.

FIG. 2 illustrates schematically a BHA arrangement of a preferred embodiment.

FIG. 3 illustrates "natural" and "unnatural" bore holes, wherein one bore hole is located somewhat vertically above the other.

FIG. 4 illustrates side-by-side bore holes, with one leg being the original bore hole and the other leg being a lateral.

FIGS. 5A–5C illustrate a preferred approach toward locating a gravity favored and gravity unfavored bore hole or lateral, in accordance with an embodiment of the present invention.

FIGS. 8A and 8B schematically illustrate one aspect of the controlled valving of a preferred embodiment of the present invention, the embodiment of FIGS. 11 and 12.

FIG. 9 illustrates schematically functional elements of a preferred embodiment of the present invention, the embodiment of FIGS. 11A–11EE and 12A–12DD.

FIG. 10 illustrates schematically an active bent sub according to the embodiment of FIGS. 11A–11EE and 12A–12DD.

FIGS. 11A–11EE and 12A–12DD illustrate kick-off and sweep sections and valving sections, respectively, with the same section shown in alternate states on top and on bottom, the same section being designated by the same alphabetic indicator, either singly or doubly.

DETAILED DESCRIPTION OF PREFERRED EMBODIMENTS

Figure 6A:
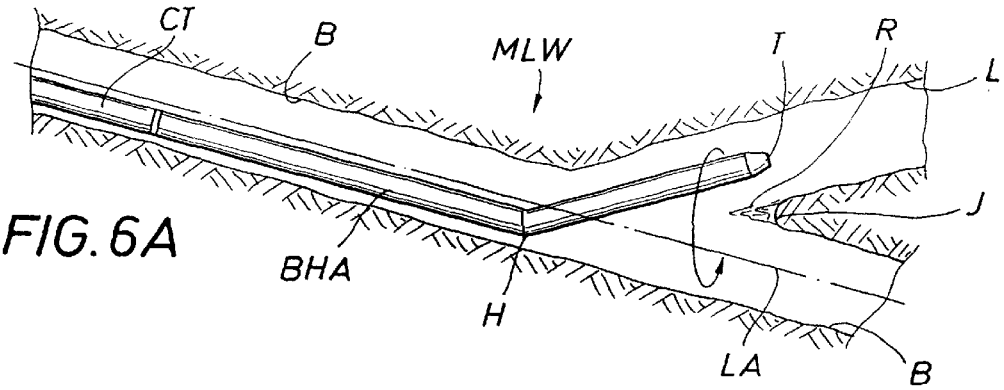
FIG. 6A illustrates a detecting step in accordance with a methodology of the present invention.
Figure 6B:
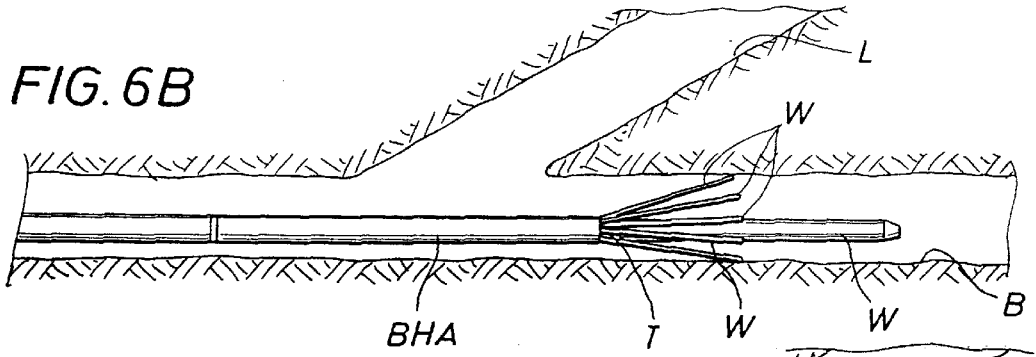
FIGS. 6B and 6C illustrate multi-toe and expandable toe or wand embodiments.
Figure 6C:
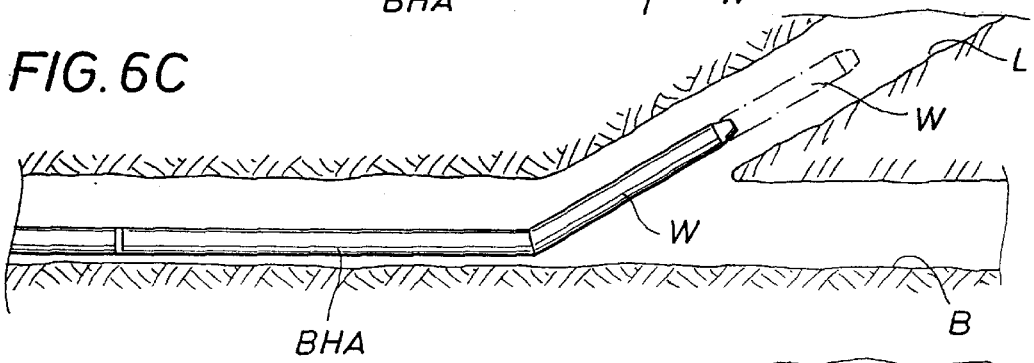

"Lateral," as used herein when indicating movement in a "lateral direction," means movement in a direction which, if drawn as a vector, would have at least a component lying in a plane LP normal to a longitudinal axis LA of a bore hole B. See FIG. 1. The "radial" direction RD lies in the lateral plane LP and is a direction outward from a bore hole longitudinal axis. While lateral adjustment is movement with a component at least in the lateral plane, frequently given the circumstances, lateral adjustment is movement tangential to the radial direction, or at least with a significant component T tangential to the radial direction. See FIG. 1. The simplest lateral adjustment of a toe in a bore hole is generally circular movement CM about a bore hole longitudinal axis LA tangential to the radial direction. See FIG. 1. More complex lateral adjustment of a toe is possible, including zigzag movement, helixing movement, back and forth movement, sinusoidal movement and any combination of the above, including combinations with longitudinal movement. In theory, a sweep sub could institute incremental or slow lateral rotations combined with vertical or longitudinal sweeps, implemented by raising and/or lowering the tubing. It is believed that a series of vertically displaced lateral sweeps, e.g., raising the tubing in 1 meter increments interspersed with 360° sweeps, should locate most laterals in an efficient manner using coiled tubing. However, an optimum "sweep" strategy may be dictated by well structure and the degree of accuracy of well information. A series of longitudinal sweeps, or laterally displaced multi-toe longitudinal sweeps, is a possible sweep strategy. (A tool could be designed so that a vertical or longitudinal component of "sweeping" motion, as discussed above, could automatically halt upon a full "kick-off" of a wand.) Thus, "sweep" as used herein, although frequently used equivalently to laterally adjusting, preferably or most simply in circular patterns, could refer to longitudinal or vertical sweeping, or vertical sweeping could be interspersed with periodic lateral adjustments.

The simplest means for carrying a toe is a wand, as illustrated by the preferred embodiment discussed in detail below. However, a toe could in theory be carried on many structures, some of which might not always resemble what comes to mind with the term wand.

When significantly lifting or significantly laterally adjusting a BHA is referred to, significantly should be understood in the context of sufficient to possibly adjust a BHA out of normal bore hole and over a ridge into a lateral.

When the BHA is said to be structured in combination with at least one toe to produce a moment of force sufficient to eccentrically bias the toe, the use of the term "eccentric" is adopted, and intended to be understood, so as to distinguish the instant invention from a centralizer. Eccentric in essence here means not like a centralizer, whose toes can be said to "centrically" bias a BHA.

Said otherwise, what is intended here is that the effect of a force "eccentrically" biasing at least one toe outwardly is not (or is at least not always) the same as that of a centralizer force. A centralizer biases outwardly a plurality of toes with a centric effect. The lateral distance between the toes and the BHA may change (as a bore hole widens or narrows). However, the BHA remains centralized within the toes. The lateral distance of the toes from the BHA, among themselves, remains essentially uniform. A centralizer might detect a widening or narrowing of a bore but no one toe (or toe set), by kicking out vis-a-vis at least one other toe, or by being "eccentrically" biased vis-a-vis at least another toe, would indicate a direction in which a lateral might lie.

In contrast, a moment of force "eccentrically" biasing one or more toes outwardly, or "eccentrically" kicking out at least one toe, would, even if working with an otherwise centralized BHA, when appropriately opposite a lateral, bias or kick out at least one toe (or toe set) into the lateral. (The toe need not kick out so far as to actually touch a far lateral wall, of course.) The distance between that kicked out toe (or toe set) and the BHA would not be the same as the distance between at least one other toe (non-similarly situated,) again if such toe should exist, including any centralizing toes. Again, toes keeping a BHA centralized maintain a more or less uniform distance among themselves from the BHA. A toe "eccentrically" biased or kicking out could assume (in the proper circumstances) a different lateral distance from the BHA than at least one other toe, again if any such other toe were present.

In the case of a non-centralized BHA with one toe, as is the case of the preferred embodiment discussed in detail herein, the issue does not arise. Any biasing outwardly or any kicking out could be deemed in that singular case to be "eccentric." The use of the terms eccentrically bias or eccentrically kick out should be so understood.

The preferred embodiments discussed below contemplate detecting and signaling a full kick-out of a toe or a wand. Alternately, of course, it would impossible to monitor degrees of kick-out at the surface. Alternately, also, and in coordination with the aforesaid monitoring it would be possible to control halting of a sweep sub from the surface. As an example, considering the detailed preferred embodiment discussed herein, the leak function instituted at the kick-out piston chamber upon fully kicking out might be restyled or redesigned with one or more leak ports so that a leak rate is created as a function of the degree of kick-out angle.

One capability of a preferred embodiment of the instant method and tool, as illustrated in the embodiment of FIGS. 2 and 5A to 7M, is an ability to select and navigate into a leg of a well into which a BHA tubing would not naturally "fall", sometimes referred to as the "unnatural hole." See bore UH, FIG. 3. Depending on the particular well, this could be a main (original hole), or it could be a lateral (branch hole.) See FIG. 4.

To achieve selection of the unnatural bore, the BHA or tool of the preferred embodiment of FIGS. 2 and 5A to 7M is regarded as divided into three main subs, or functionalities: a sweep sub SS, a kick-off sub KOS and a wand W, also illustrated in FIG. 2. Although a preferred BHA may be discussed herein as if divided into these subs, the subs could also be regarded as one, or as integrated. Such is apparent from review of FIGS. 11A–11EE and 12A–12DD. Thus, although the above-referenced subs may be distinguished and discussed functionally and structurally, they may well also be regarded as integrated functionally and structurally.

The "wand" W, FIG. 2, is preferably a bottom portion of a BHA, or tool, a portion that selectively swings away from alignment with the main body or longitudinal axis TLA of the BHA, to detect and to enter into a leg. The wand W of the preferred embodiment frequently illustrated herein has advantages of simplicity by carrying a toe T upon its end. Toe T preferably comprises a bull nose and a jetting nozzle. (E.g., see jet nozzle and bull nose 172, with jets 174, of FIG. 11E,) discussed below. Wand W preferably provides for fluid communication through its length. (See channel 170 in FIG. 11E, as discussed below.)

The kick-off sub KOS, FIG. 2, is a selectively active hinge joint in the preferred embodiment. The hinge attaches the wand W to the main body of the BHA. The sweep sub SS rotates the kick-off sub KOS and the wand W about an axial axis of the BHA.

At this point it will be mentioned that there could be more than one toe, or more than one wand. See FIG. 6B. For instance, a plurality of toes or wands W could be used to detect a junction.

A plurality of laterally displaced toes or wands may require no lateral rotation. They could be kicked out and longitudinally swept. A single toe or wand W could have its length adjustable down hole, as by telescoping. See FIG. 6C. One length could be used for detecting (preferably a shorter length) and a second length (preferably a longer length) could be used for leading off into a lateral. The preferred embodiment discussed in detail below, as built and tested to prove the methodology, uses one toe carried on one wand. Such design at least has the advantage of simplicity of structure. Initial testing has demonstrated its effectiveness.

So-called "full kick-off" of a wand or a toe indicates a degree of radial deflection for a wand or toe that is equal to or greater than some predetermined amount. See for instance the methodology indicated in FIGS. 7A–7M, and in particular FIGS. 7E–7J. The predetermined amount, for instance, would typically be calculated to be greater than that which could be achieved in a single bore hole. In the preferred embodiment discussed below, a full kick-off for a toe is set at a predetermined angle, such as a 15° angle with a BHA longitudinal axis. Allowance for bore hole diameter while detecting full kick-off is taken care of by adjusting the length of the wand.

A further consideration in structuring and operating the present invention is whether or not the BHA will be centralized. (A plurality of deflectable, biasable toes could even be incorporated into a centralizer design.) A BHA could, and likely might, contain other tools, such as jetting tools or vacuuming tools or perfing tools or testing tools or stimulating tools or workover tools. With centralizers, there is less concern for the limit of the biasing force of a deflected toe or wand. Depending upon the strength and the placement of the centralizers, it may be quite difficult, or take quite a large force, to laterally adjust a centralized BHA. On the other hand, a greater force may be required to force a centralized BHA between two ridges defining a border of a lateral with a main bore hole.

Figure 7A:
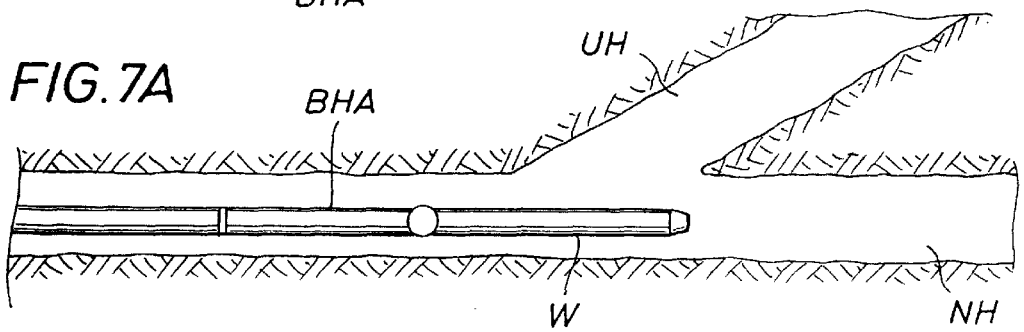
FIGS. 7A–7M illustrate a series of operational steps in accordance with a preferred embodiment of the present invention, the embodiment illustrated in FIGS. 11A–11EE and 12A–12DD.
Figure 7B:
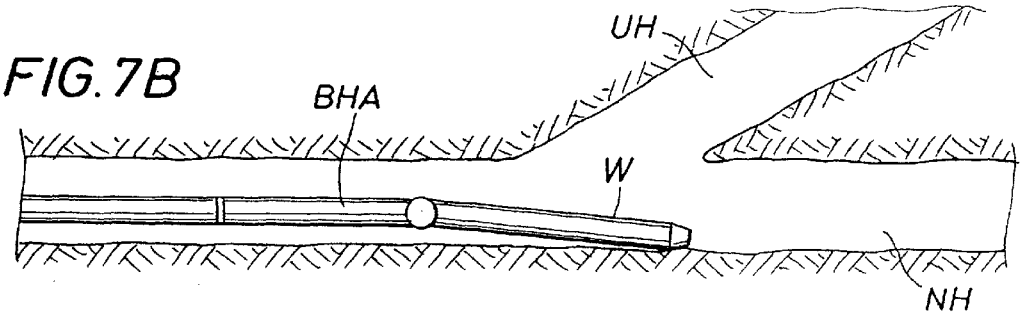
Figure 7C:
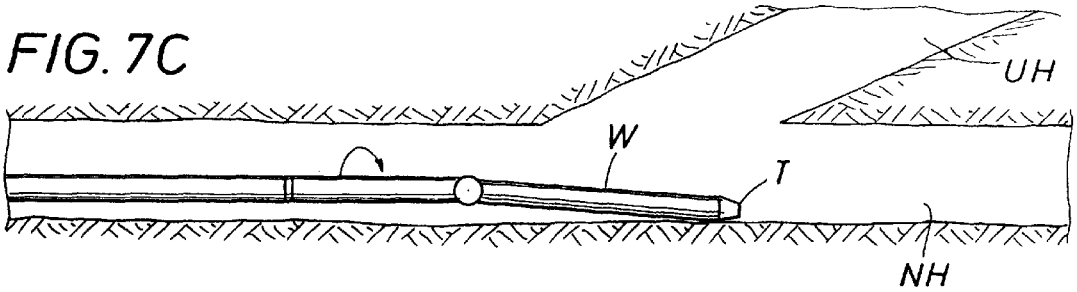
Figure 7D:
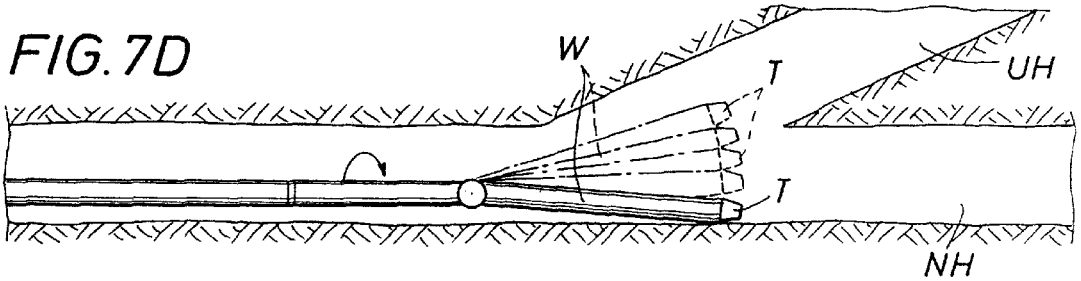
Figure 7E:
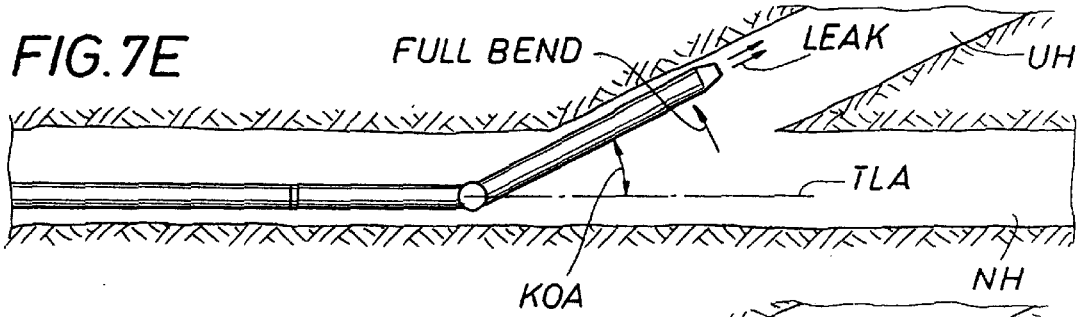
Figure 7F:
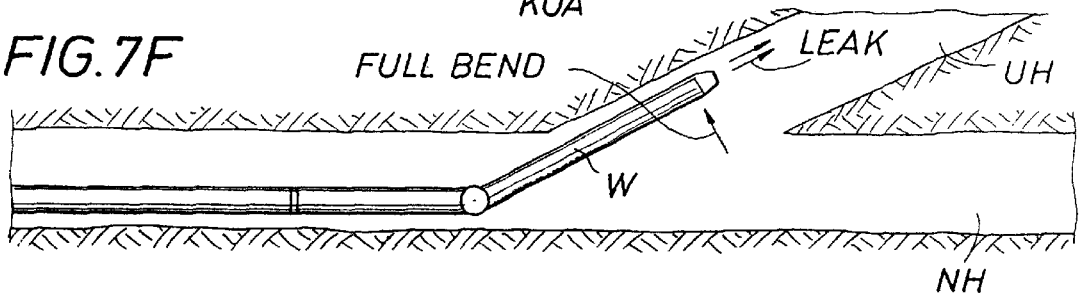
Figure 7G:
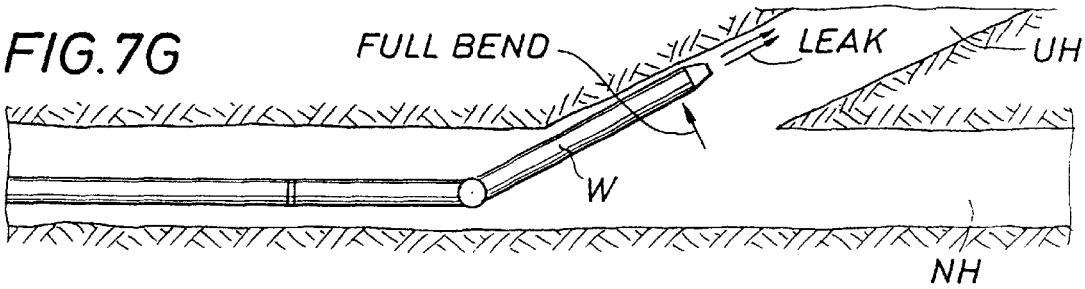
Figure 7H:
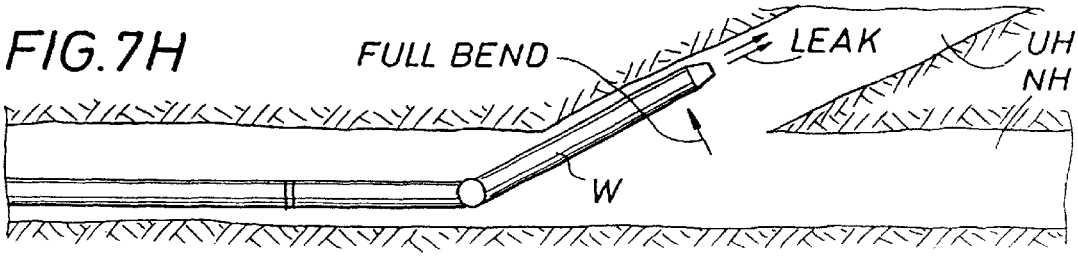
Figure 7I:
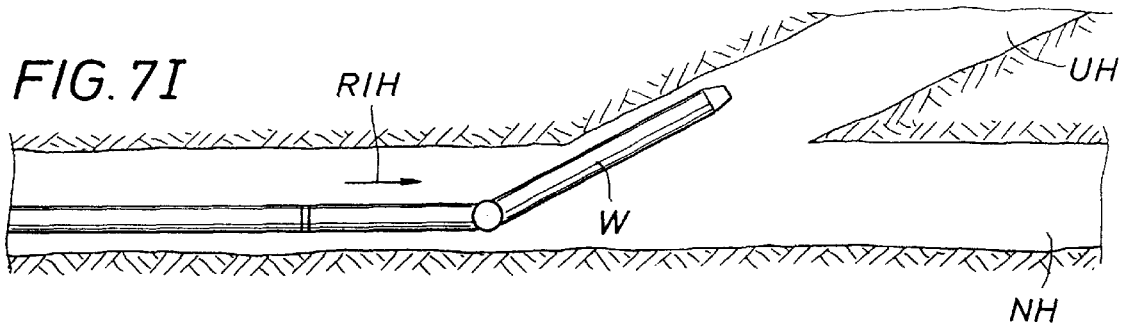
Figure 7J:
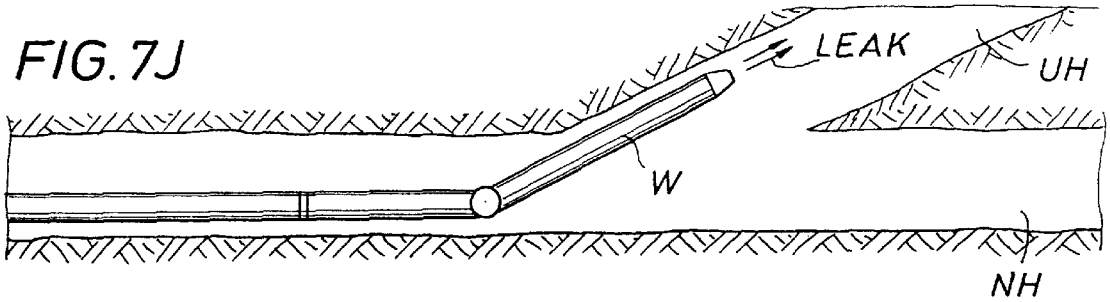
Figure 7K:
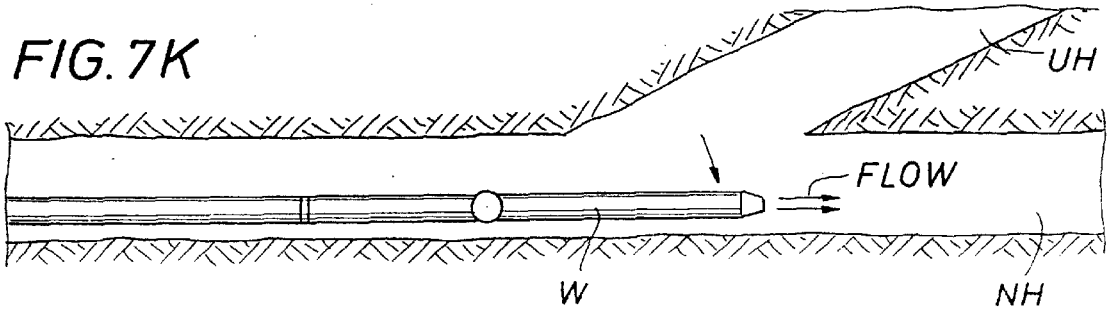
Figure 7L:
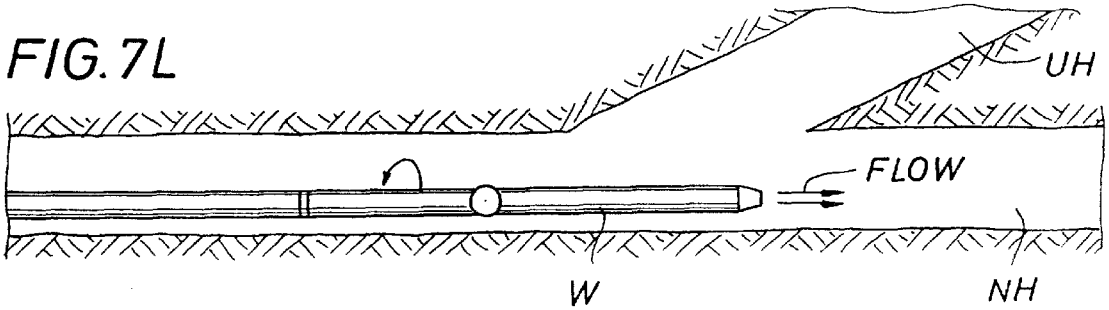
Figure 7M:
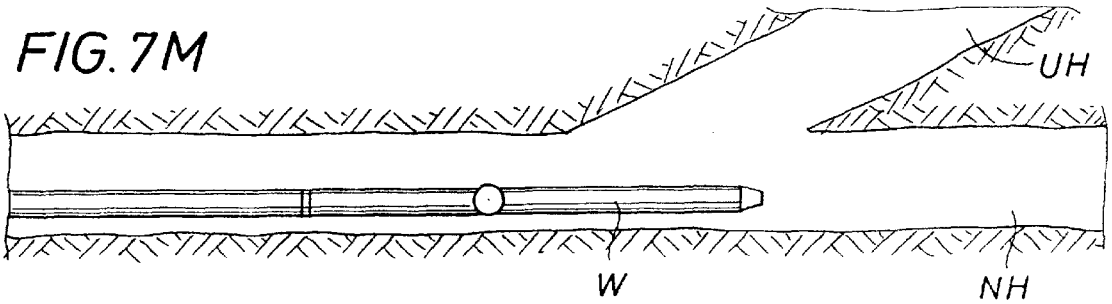

The tool of the preferred embodiment illustrated in detail herein operates by applying pressure differentials through the tubing and across the tool, the effect of the pressure differentials being schematically illustrated in FIGS. 7A–7M. After running in the hole straight and tagging bottom, FIG. 7A, preferably the tool is then pulled back to a location of an estimated junction, FIG. 7B. The tool is designed to then kick off in response to an applied pressure, (e.g., coil pressure of 2500 psi, FIG. 7B.) The tool then begins to sweep. FIGS. 7C, 7D. If the tool is located across a junction (and preferably the BHA is biased by gravity toward a bottom and lower bore as best illustrated in FIG. 6A) the wand can "fully" kick-off during an appropriate portion of a lateral sweep cycle. See FIGS. 7E–7J. Upon fully kicking off, preferably the tool starts leaking pressure fluid and automatically stops sweeping, FIGS. 7E–7H. Preferably this pressure adjustment is seen at surface, and interpreted as a signal. The leak preferably maintains the pressure fluid in the BHA sufficient to maintain the kick-off but insufficient to maintain the sweep. The valving mechanism to accomplish this methodology is discussed below. FIGS. 7F–7H indicate a slow reduction in BHA pressure.

It can be presumed that a straight BHA will follow a natural bore, usually the bore dictated by gravity. See FIG. 7A. To select the "unnatural hole," or hole unfavored by gravity, a wand or "toe" of the preferred embodiment must enter the "unnatural hole," as illustrated in FIG. 7E, as opposed to the BHA or "heel" H being lifted up.

To digress momentarily from FIGS. 7, the desired entry of a radially deflected wand into the unnatural hole is further illustrated schematically in FIGS. 5B and 5C. The scenario of FIG. 5A is to be avoided. FIG. 5B illustrates a wand fully kicked off with the wand in a widened bore hole created by the junction. FIG. 5C illustrates a wand with the biasing force in the radially deflected direction sufficiently limited such that as a deflected wand, when it is rotated vertically lower than the rest of the BHA, tends to collapse into alignment with the BHA longitudinal axis. Because the biasing force radially deflecting the wand is sufficiently limited, the wand does not, as illustrated in 5A, remain radially deflected and lift the BHA up, or laterally adjust the BHA, from the position the BHA would naturally assume by virtue of gravity, inertia and/or friction in the bore hole. FIG. 5A illustrates that if the radially deflecting force is not properly limited, a wand could fully deflect or fully kick off while it is oriented toward the "natural" bore hole by virtue of being able to lift the BHA against gravity, friction and/or inertia. Thus, preferably the kick-off force biasing a wand outwardly is sufficient to lift the wand vertically against the force of gravity but insufficient to significantly laterally adjust a BHA center of gravity, or "heel" H. Rather, the kick-off biasing force is structured to be sufficiently small that the wand collapses so to speak in line with the BHA longitudinal axis upon rotation down, or under the BHA. The more deviated a "naturally" favored bore hole, the greater the effect and assistance of gravity in this regard. However, friction and inertia alone, of both tubing and a BHA in a "natural" vertical bore hole, may give a sufficient degree of stability and resistance to lateral adjustment of a BHA, whose mass is preferably significantly greater than the mass of a wand or toe, so that the wand resists laterally adjusting any BHA out of its naturally favored bore hole.

A natural ridge R, particularly illustrated back in FIGS. 3 and 4, formed between a main hole and a lateral hole, as well as any change in elevation of the two holes, assists and aids in the outcome of a toe entering and kicking off in the "unnatural" hole. Again, a tool can assist in achieving this objective by a judicious crafting of the available kick-off moment in the BHA. E.g., enough of a moment is applied to lift a wand vertically however not enough to push a BHA or BHA heel over the natural ridge. In many cases, gravitational force alone may be sufficient to keep the heavy portion of the BHA (including tubing and other tools of a BHA)

from moving out of the bottom of the hole. Thus, the tool of the preferred embodiment can be said to make use of the frequently encountered characteristics of a multilateral junction profile as well as of the earth's gravity to enhance the effectiveness of the tool.

Returning to the methodology illustrated in FIG. 7, control valving preferably controls tool mode and activation pressures, controlling the events illustrated in FIGS. 7A–7M. Preferably, a sweep sub automatically stops, as indicated in FIG. 7E, when a wand fully kicks out, the mechanics of which are more fully illustrated in FIGS. 11A–11EE, and 12A–12DD, discussed below. Preferably a pressure drop signal upon full kick-out is received at the well surface, communicated through the tubing.

The tool preferably operates by using pressurized fluid from the tubing, preferably coiled tubing, as a power fluid. By pressuring up the tubing with fluid, FIG. 7B, the tool can be designed and structured to first kick-off a wand, FIGS. 7B and 7C, and then to begin to sweep, FIG. 7D. In a preferred embodiment a wand pushes out at its tip or toe T, biases against bore hole wall portions, and then is swept 360 degrees laterally around the bore hole, preferably no faster than 1 revolution per 1 minute, looking for a widened bore hole indicating a junction. See FIG. 7E. If the tool is appropriately opposite a junction, the wand will be able to fully "kick-off" at some point during the sweep cycle. FIG. 7E. When fully "kicked out," the wand then having an angle KOA with a tool longitudinal axis TLA greater than or equal to a predetermined angle, the tool preferably automatically stops sweeping and a pressure signal is seen at surface (e.g., the tool starts leaking.) FIG. 7E. It is now possible to follow the wand or toe and run into an "unnatural hole," as the wand tip or toe is designed to have entered an "unnatural hole." (E.g., as discussed above, the tool is preferably designed to make use of its own weight, BHA weight and wand weight, to keep the BHA in the lower or natural leg while a wand tip or toe is permitted to sweep into a horizontal or higher hole.) The sweep rotation speed is preferably controlled to 1 rev/min to help ensure that sweep moment forces are not created that lift a BHA heel over a ridge and into an unnatural hole.

To summarize FIG. 7, when a tool is initially RIH, it is normally straight and will typically consistently pick one of the legs available, referred to as the "natural" hole. By tagging well bottom it is almost always possible to determine which leg the tool is in. By pulling the tool up to an estimated junction or window depth and activating a kick-sweep-leak function, the tool has proven to be able to detect "other" legs as tool and tubing weight, inertia and friction keep the main BHA tool in the hole it was originally in. The wand tip or toe has been proven able to detect an "other" leg, assisted by longitudinal adjustments up and down around an estimated window location. When the tool is subsequently run into the well, lead by a fully kicked-out wand and following a "leak" or pressure change signal, the kicked-off wand tip steers the BHA and tubing to follow into the "other" leg into which it has kicked off. Bottom can be tagged with this run to help insure that the correct lateral bore was located.

BHA Details—FIGS. 11A–11EE and 12A–12DD. NOTE: In FIGS. 11A–11EE and 12A–12DD some simplification of parts and unification of structure has been made for the sake of clarity.

Figure 11A:
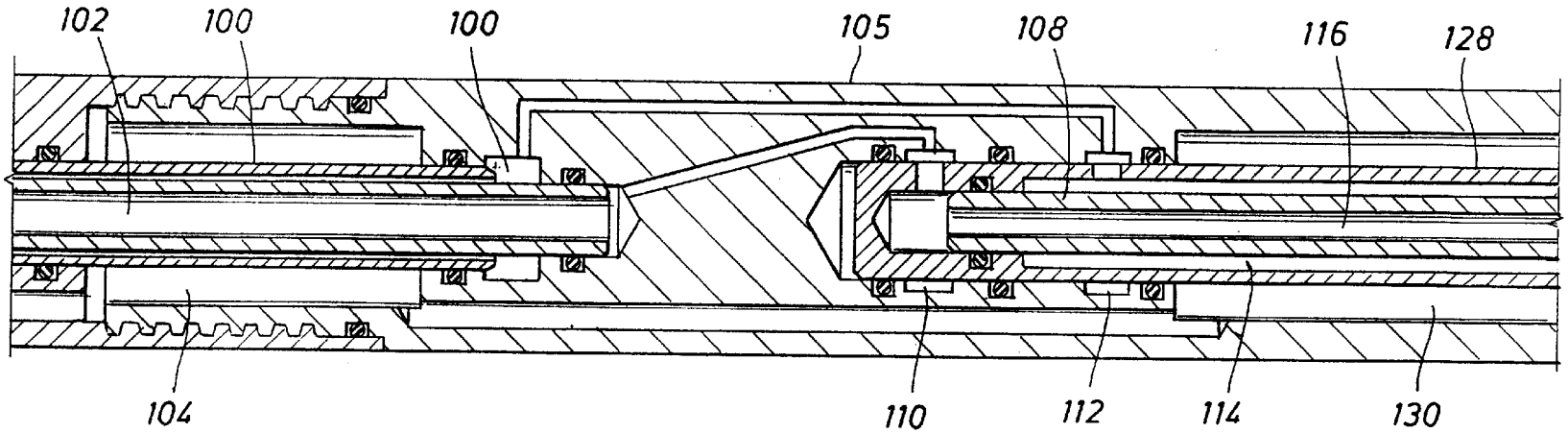
FIGS. 11A–11EE and 12A–12DD illustrate in mechanical detail a preferred embodiment of a BHA of the present invention.
Figure 11A:
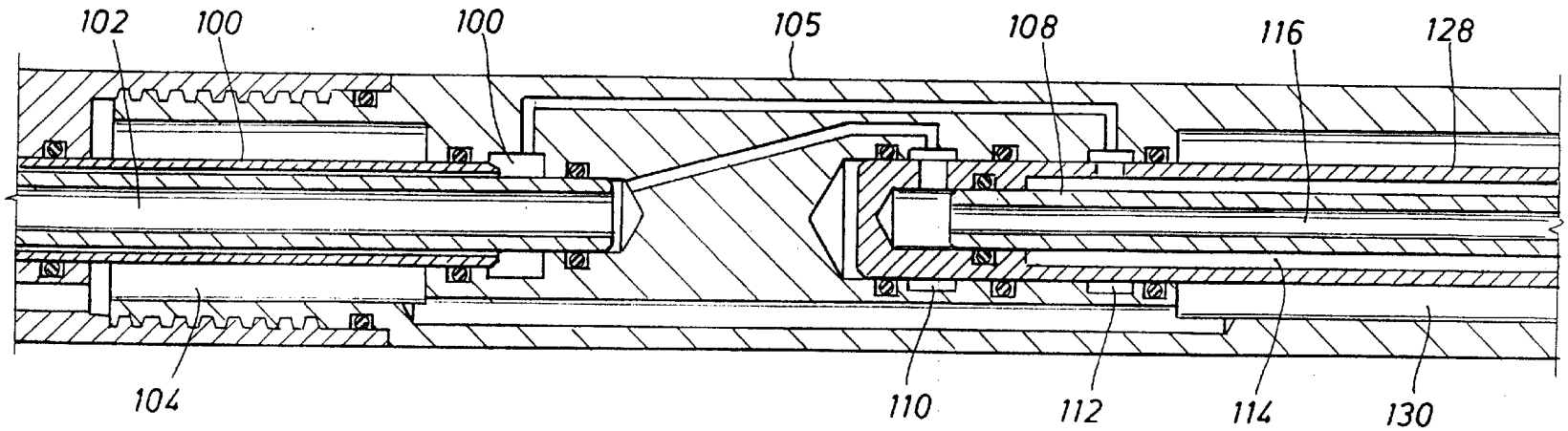
Figure 11B:
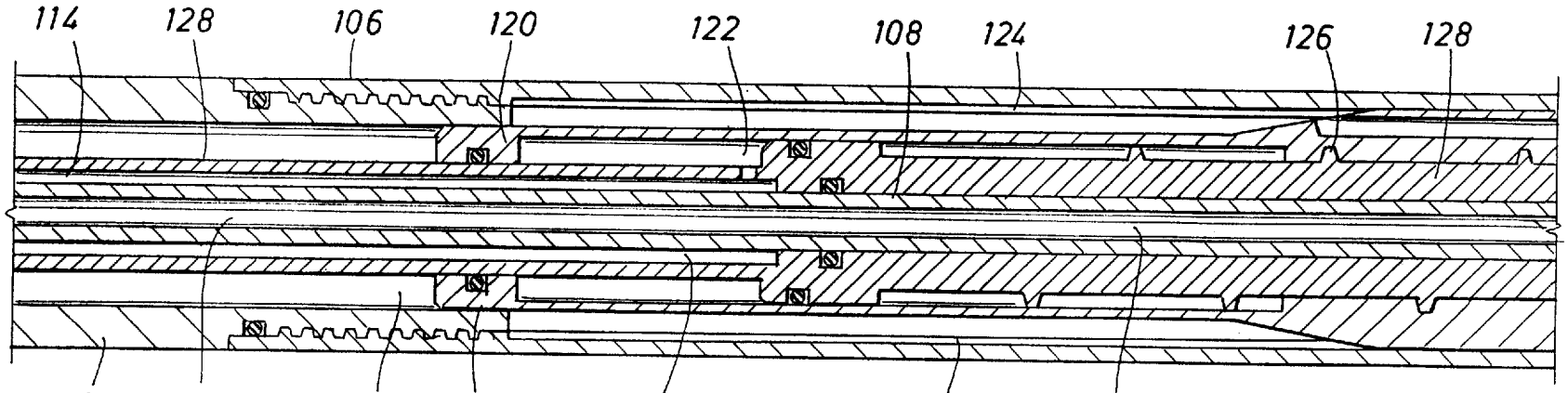
Figure 11B:
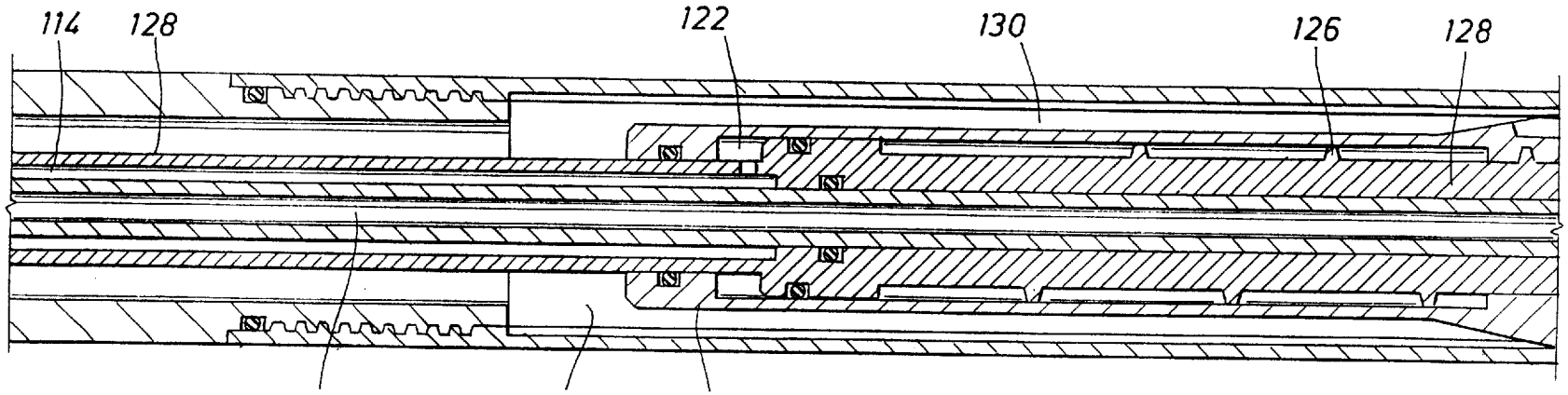
Figure 11C:
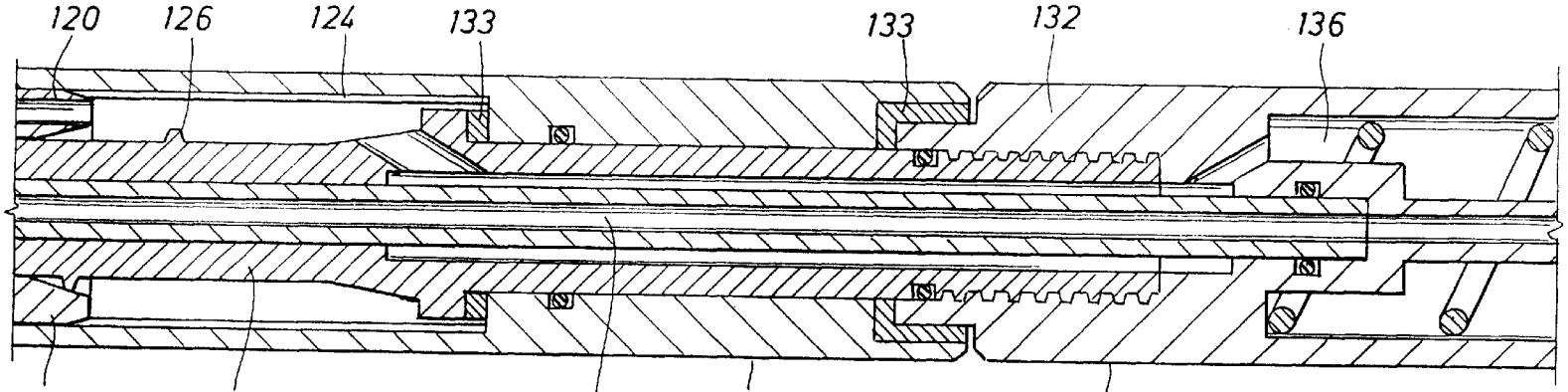
Figure 11C:
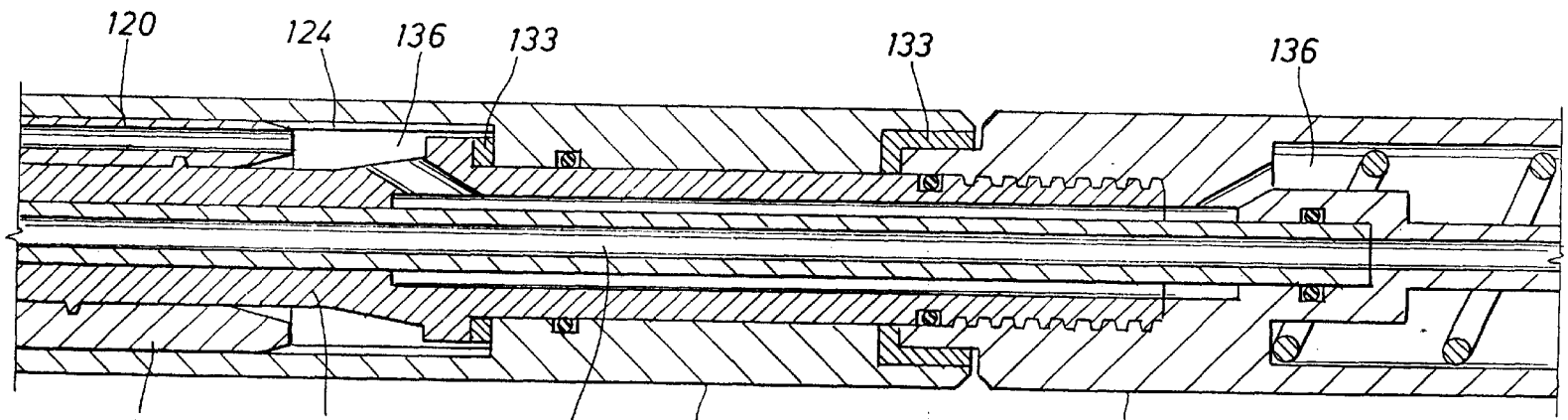
Figure 11D:
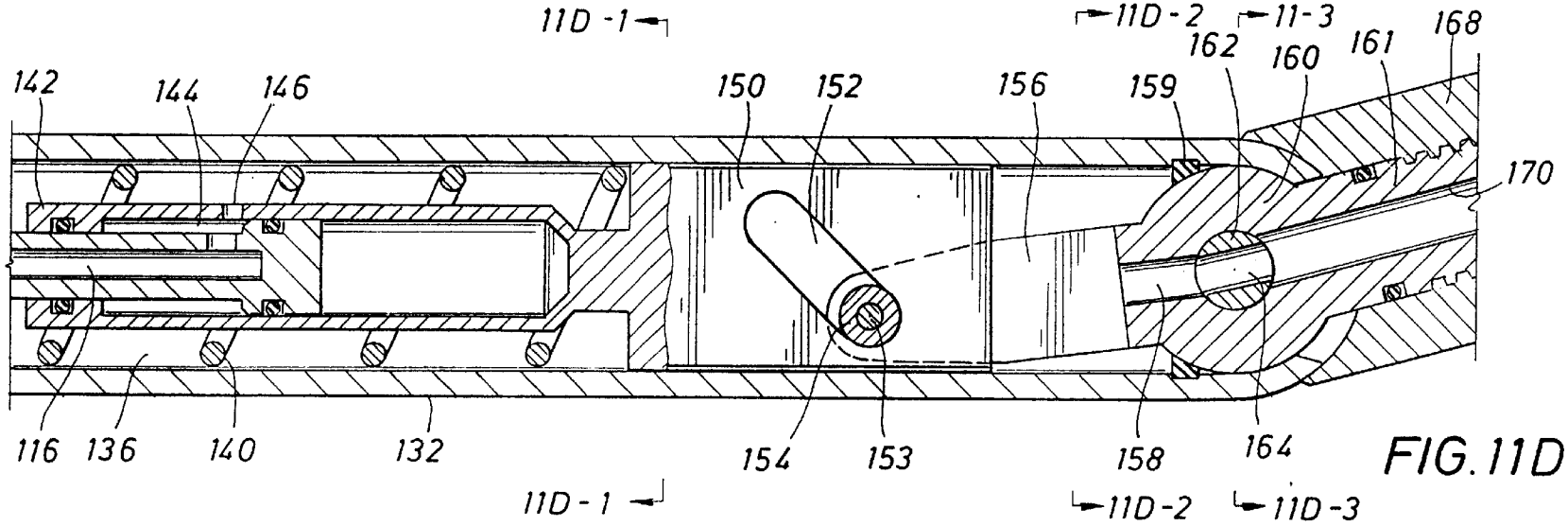
Figure 11D:
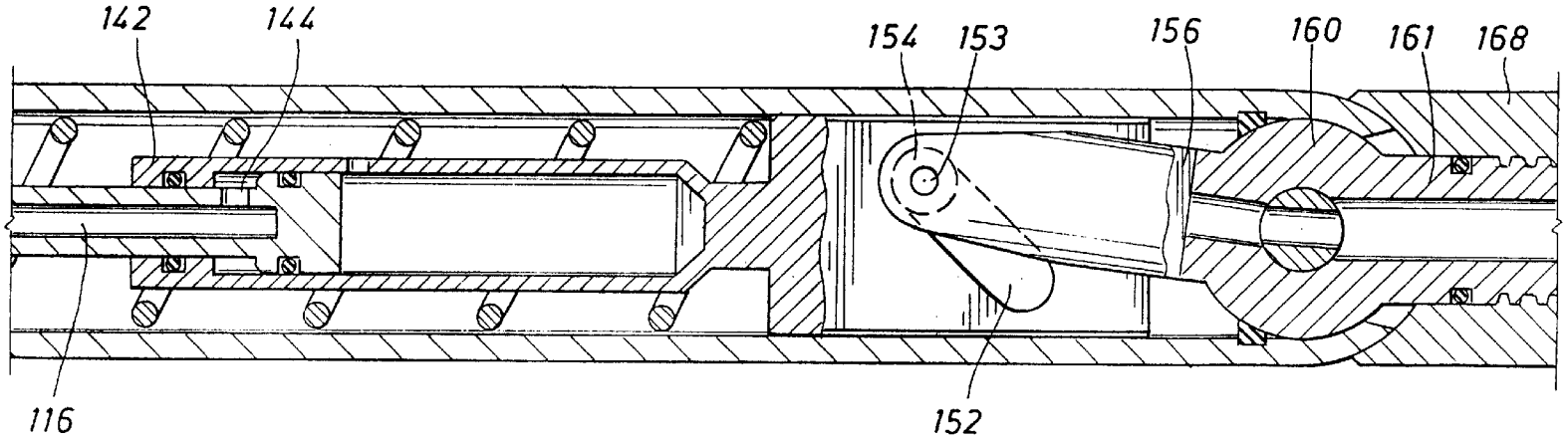
Figure 11E:
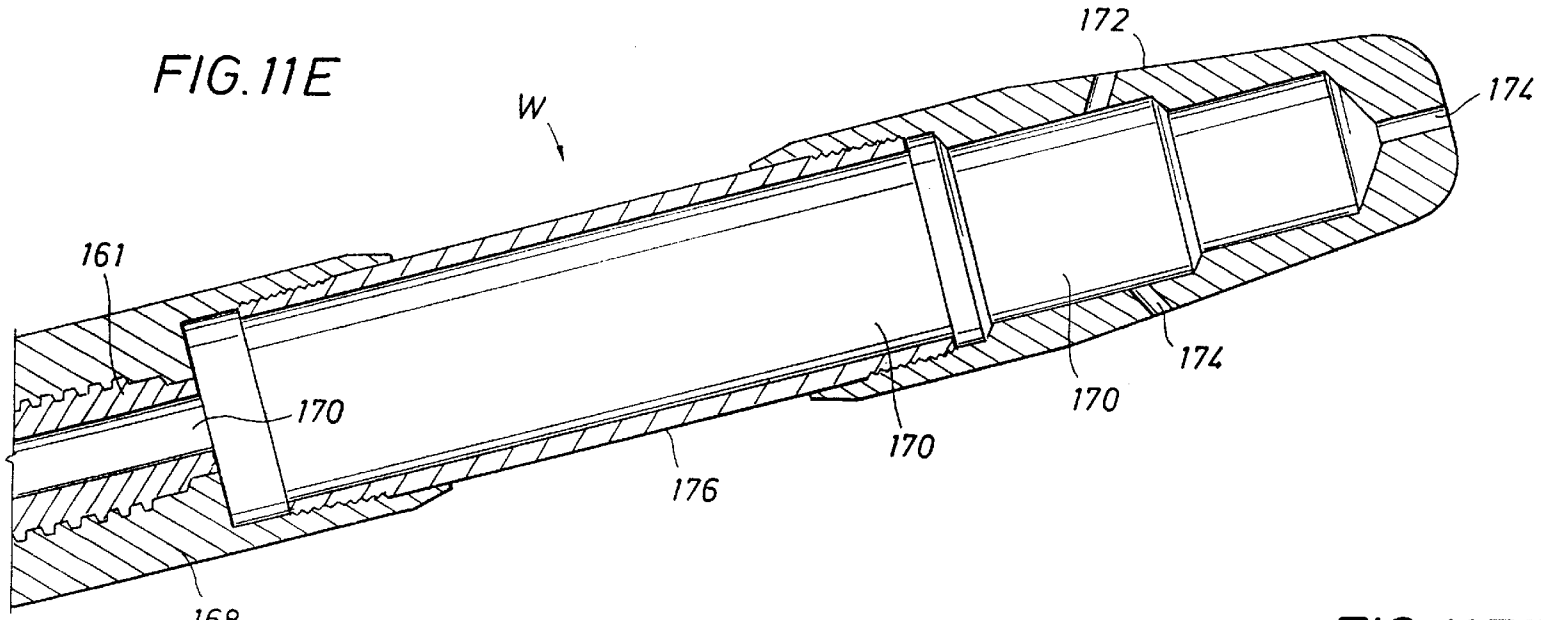
Figure 11E:
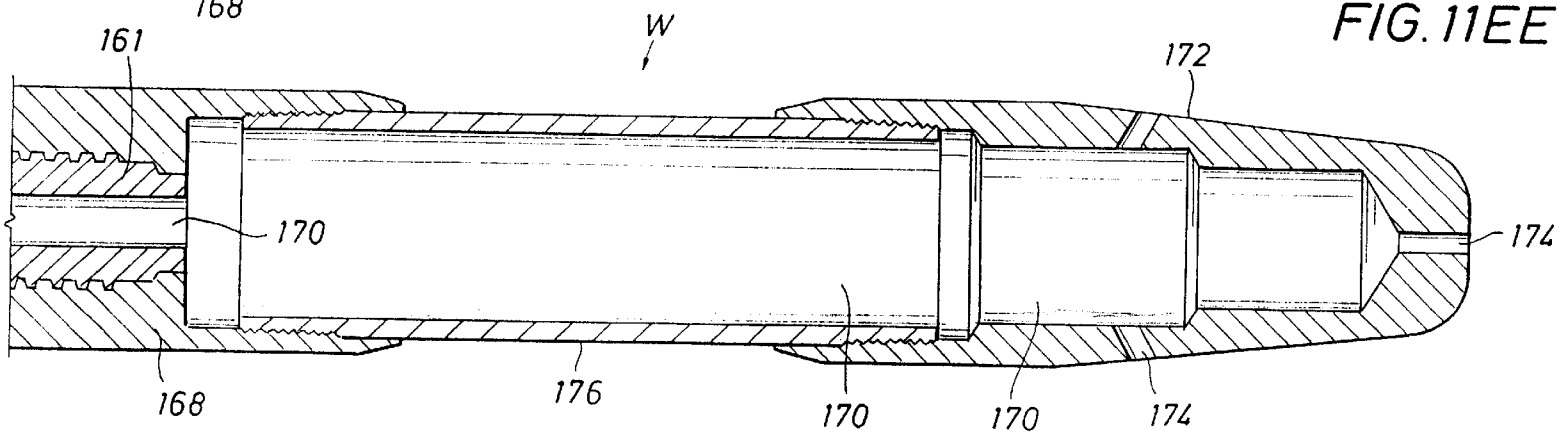

Wand—FIGS. 9 and 11E and 11EE. Wand W preferably includes a lightweight pipe, element 176, with a bullnose 172 on the lower end forming a tip or toe T. The bullnose shape is designed to help the wand find the "other" leg and not hang up on obstructions. Preferably the wand also includes some form of jetting nozzle, ports 174 on bull nose 172. The wand length, in the preferred embodiment illustrated, may be determined by considering the relative geometries of the multilateral junction to be located, together with the geometry of the BHA and the natural bore hole. The larger the bore hole diameter, in general, the longer the wand of the preferred embodiment, which design allows a "fully kicked-out" wand position to be defined as approximately a 15° angle with a BHA longitudinal axis. A further consideration in regard to wand length is whether or not the BHA is centralized. Conduit 170 provides for fluid communication through the wand from the active kick-off sub. FIG. 11EE illustrates a non-kicked-off wand, and FIG. 11E illustrates a fully kicked-off wand.

Active kick-off sub—FIGS. 11D–11DD—The active kick-off sub KOS is preferably a piston activated assembly, spring-loaded to be normally straight. FIG. 11DD. The activation piston 142 preferably uses selected, valved tubing pressure through channel 116 into chamber 144 to axially pull a mechanical assembly against a compression spring 140 and move slotted plate 150. Slot 152 in plate 150 is angled to allow a cam follower 154 to move sideways as the plate retracts (from left in FIG. 11DD to right in FIG. 11D.). The sideways motion of the cam follower pivots cam arm 161 and attached wand portion 168 about a ball socket assembly 160. Ball socket 160 is secured to the sub by a central pin 162 to allow for pivoting and sealed by seal element 159. Yoke arm 156 attaches to cam follower 154. (FIG. 10 also illustrates these elements of the active bent sub.) Ports 158, 164 and 170 through the socket and pin provide for fluid communication there through to the wand W.

The kick-off sub is designed to work in concert with the wand, the compression spring, the fluid pressure and the valving to craft the radial moment developed. The sub preferably develops sufficient radial kick-off moment, through hydraulic activation of piston 142, to pick up the weight of the wand and bias the wand against a bore hole wall, up to a predetermined kick-off cycle, but not enough radial moment to lift the main tool assembly or to significantly laterally rotate the BHA as connected to the tubing, from the bottom of a "natural" hole. In particular, pressure radially inward on the wand tip by the bore hole wall pressures cam follower 154 to move to the left. If, or when, this force plus the force of compression spring 140 overcomes the force of fluid pressure in chamber 144 against piston 142, piston 142 will move to the right, toward the configuration of FIG. 11DD.

Careful control of friction is another consideration. One factor in designing a wand to initially kick over (activation mode) and then straighten if it happens to sweep under the BHA, is controlling friction in the kick over. Keeping friction to a minimum within a moving kick over assembly allows better control of the wand biasing force.

Another design feature of the active kick-over joint is the bending strength of the ball socket design. Although friction is minimized with the enclosed style of the joint, joint strength remains high to give the kick-off sub robustness. Without causing damage to itself, the joint is capable of sustaining much higher forces on it than it is capable of biasing.

Sweep sub—FIGS. 11A, 11AA, 11B, 11BB, 11C and 11CC.—The sweep sub SS of the preferred embodiment is also a piston activated assembly, but is not spring-loaded.

When the tubing is sufficiently pressured as determined by the BHA valving, sweep action fluid pressurizes channel 100, chamber 112, channel 114 and chamber 122. Sweep sub piston 120 moves axially within a straight, keyed housing chamber 130. A keyway 124 ensures that the piston assembly cannot rotate. Rotatable shaft 128 is inserted into and thru this piston and has an angled or helixed spline 126 machined onto its exterior. The sweep sub piston has a mating spline indentation. Thus, when the sweep sub piston assembly moves axially, the inner shaft 128 rotates. The assembly is designed for a full, 360 degree rotation. The inner shaft rotates both ways (LH and RH) depending on which direction the piston travels. During tool activation, the sweep piston rotates the wand using a threaded connection between rotating inner piston 128 and kick-off sub housing 132. See FIGS. 11C, 11CC. To reset the sweep for another try, fluid pressure through channel 104, FIGS. 11A, 11AA, as arranged by the BHA valving discussed below, is developed in chamber 130, FIGS. 11B, 11BB, around the sweep sub piston OD, which pushes the sweep sub piston assembly in the reset direction, indicated in FIG. 11BB.

Valving—FIGS. 12A, 12AA, 12B, 12BB, 12C, 12CC, 12D, 12DD and 8A and 8B.—Valving in the illustrated preferred embodiment of a BHA is designed to control tool modes. The valving preferably forms an upper tool part or BHA section, closest to the tubing (or to other tools of the BHA).

The main valve is preferably a spring-loaded open/close valve. See schematic FIGS. 8A–8B. That is, the main valve, a non-throttling mechanical detent valve, is spring-loaded and normally closed FIG. 8A. As closed, the main valve allows coil tubing pressure to activate the tool's kick-off/sweep/leak functions. Higher pressure snaps the valve open to permit flow through the tool and to reset the tool kick-off/sweep/leak functions. See illustrative FIG. 8B.

Figure 12C:
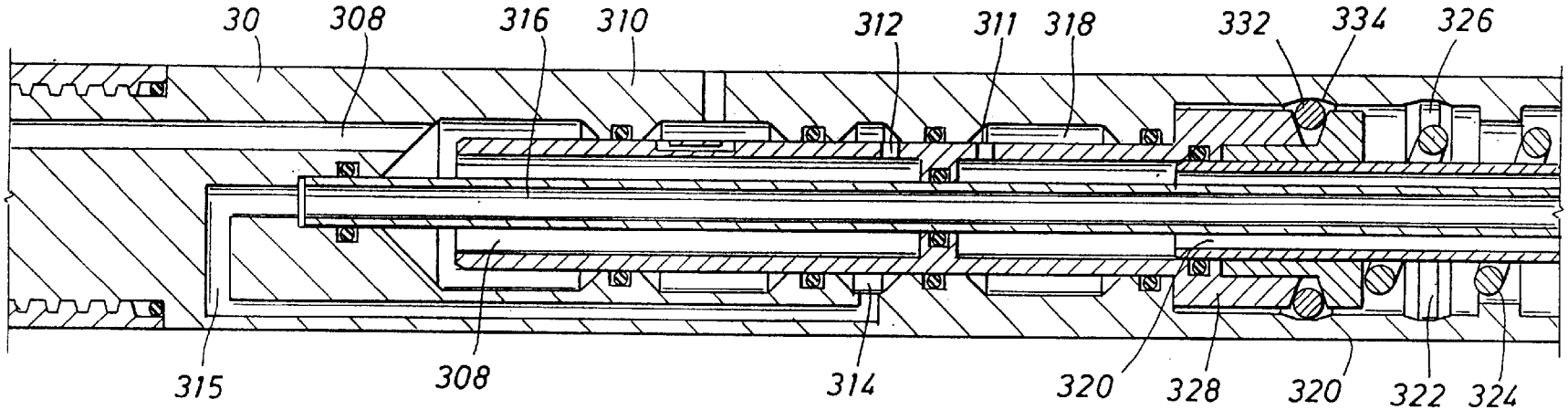
Figure 12C:
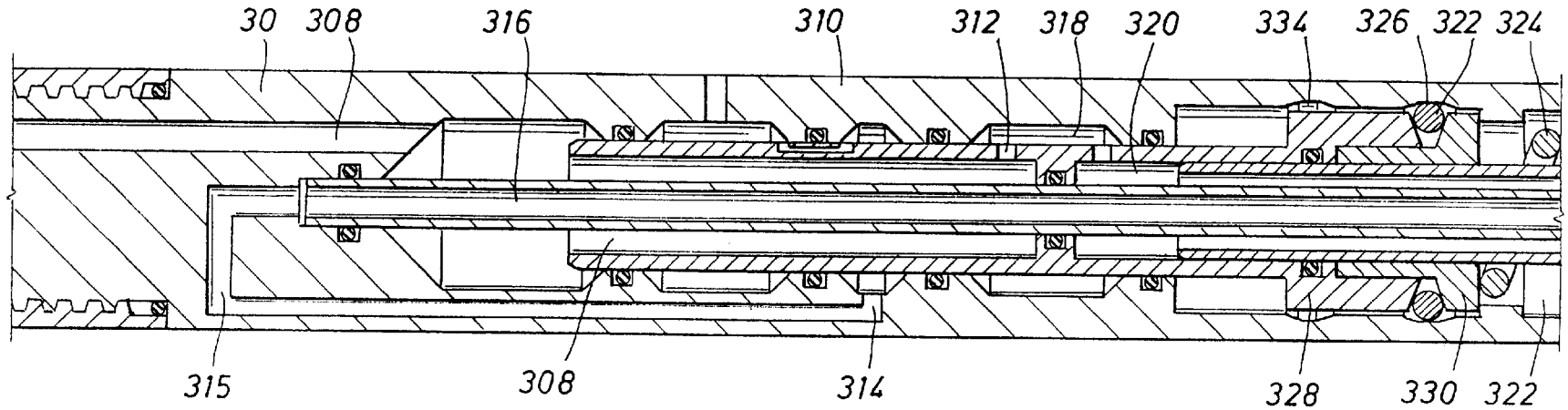

Referring in more detail now to FIGS. 12A–12DD, the main valve assembly is assisted with detent grooves 334 and 326. FIGS. 12A and 12AA illustrate in symbolic form a fluid pump 300 atawell surface having a flow meter 302 and a pressure gauge 304. The fluid pump flow meter and pressure gauge are connected to tubing 306, preferably coil tubing. In FIGS. 12 following, the upper Figure denominated with the single letter indicates the tool in a kick-out and sweep mode. The lower Figures, indicated by double letters, indicate the tool and associated apparatus generally in a circulation/reset mode. (FIG. 12DD also indicates the poppet valve in a kick-out but not sweep mode.)

The spring 324, FIG. 12C, and detent groove 334 hold this main valve assembly, in particular piston 312, normally closed, as per FIG. 8A, and allow for pressure to be developed within the BHA. It is this tubing pressure, developed from tubing conduit 308, that causes the kick-sweep-leak action of the tool.

In general, with the detent valve closed as per FIG. 12C, the tubing is essentially a closed volume. No flow through the tubing can be performed with the main valve closed. As the tubing is pressured up with the main valve closed, the kick-off assembly starts to pivot or kick-off or radially bias the wand tip. It takes a predetermined pressure to fully kick the wand tip. The kick-off activating piston, discussed above, is spring-loaded, normally biasing the wand straight. There is a secondary valve 362 in the preferred embodiment of the valving tool, called a poppet. This valve is similar to a relief valve and does not allow pressure into the sweep assembly until the kick-off pressure has been reached. At a predetermined pressure, the poppet opens and allows pressure into the sweep piston, rotating the active kick-off wand assembly. Analogously, when the kick-off assembly leaks, the flow across the poppet and its corresponding pressure drop across the poppet drops to a level that the poppet shuts off fluid pressure to the sweep sub piston chamber, stopping rotation of the sweep sub.

Figure 12D:
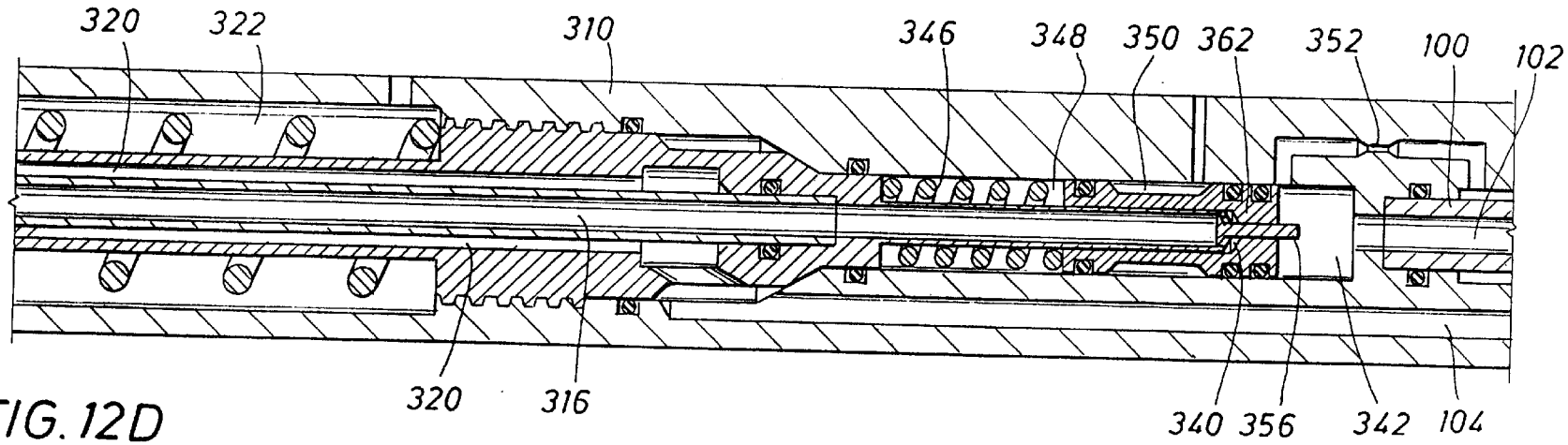
Figure 12D:
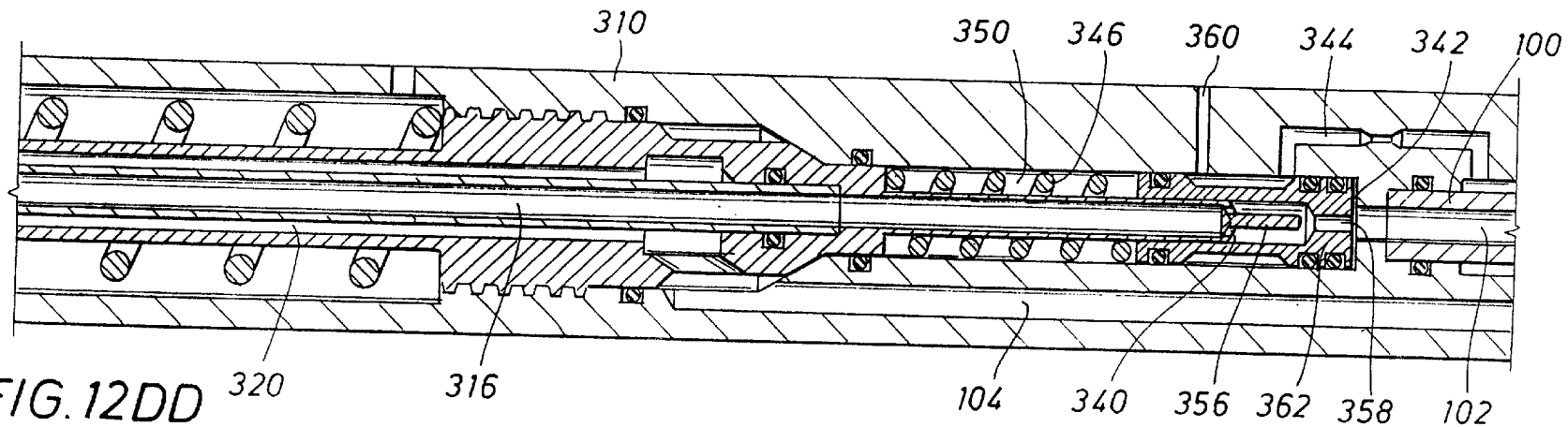

To review the valving functions in more detail, as illustrated in FIGS. 12B, 12BB, 12C, 12CC, 12D and 12DD, assume fluid conduit 308 through tubing 306 begins to pressure up. In the preferred embodiment illustrated, a first event occurs when pressure reaches approximately 2,000 psi. In FIG. 12B, pressure slowly rises in conduit 308. Referring now to FIG. 12C, pressure in conduit 308 is communicated through port 312 and chamber 314 and conduit 315 into central conduit 316. This flow is governed by piston 311 which governs the function of the main valve assembly. Piston 311 is maintained in its first closed position by virtue of spring 324 acting upon elements 330 and 328 as well as by ring 332 resting in detent groove 334. Continuing now to FIG. 12DD, poppet valve 362 is biased by spring 346 to its full right position as illustrated in FIG. 12DD. Pressure fluid from conduit 316 flows through small ports 340, around stem 356, through poppet port 358 and into inner fluid channel 102.

As discussed above in reference to FIGS. 11A through 11EE, fluid in conduit 102 flows into chamber 110 and thence into conduit 116. Fluid in conduit 116, when it reaches the kick-off sub activation pressure, which could begin at approximately 2,000 psi, begins to move kick-off sub piston 142 from its inactive position, illustrated in FIG. 11DD, to its kicked-off position, illustrated in part in FIG. 11D (but not necessarily into its fully kicked-off position, as actually illustrated in FIG. 11D). We will assume initially that in fact the wand does not move into its fully kicked-off position as illustrated in FIG. 11D but only into the degree of kick-off that the wand would assume when the wand is biasing against the walls of a normal bore hole, not a junction. In such position, piston 142 is moved to the left, compressing spring 140, but has not moved so far to the left that fluid from piston chamber 144 leaks through port 146.

Returning to FIG. 12DD, when fluid in poppet piston chamber 342 reaches a sufficient pressure to overcome the bias of spring 346 (residing in chamber 350 in which there is essentially no fluid pressure), poppet 362 moves to the left, as illustrated in FIG. 12D. (It is important to note that stem 356 fits within poppet piston port 358 but does not seal against port 358. Therefore, as illustrated in FIG. 12D, fluid in chamber 316 continues to flow through ports 340 and between stem 356 and poppet port 358 and into chamber 342, illustrated in FIG. 12D. The stem 356, when inserted in port 358, inhibits the speed of this flow. With poppet 362 moved to its open or left position, FIG. 12D, which could occur at a set pressure, such as 2,400 psi, fluid pressure in chamber 342 now communicates not only with conduit 102, which communicates with the kick-off sub, but also communicates through conduit 344, past restriction 352 and into conduit 100. As illustrated in FIG. 11A, fluid pressure in conduit 100 communicates through chamber 112 with fluid pressure in annular conduit 114. Fluid pressure in annular conduit 114 communicates with the piston in the sweep sub, and as discussed above, causes piston 120 of the sweep sub to move to the left by virtue of pressure in chamber 122. Absent change, sweep piston 120 will continue to move to the left until it reaches its limit of travel. The limit of travel is designed to rotate element 128, moved by spiral helix 126, in at least a 360° circle.

As can be seen from FIG. 11D, if the wand is allowed to fully kick out, as provided for instance by a widened bore hole junction, then kick-off piston 142 will move fully to the left and chamber 144 will begin to leak fluid from conduit 116 out port 146. Fluid leaking out port 146 can travel through the kick-off sub and the wand and out the jet nozzle ports 174 of wand W. As review of FIGS. 11 reveal, fluid pressure in conduit 116 is linked with fluid pressure in conduit 102.

Returning to FIG. 12D, when fluid pressure in conduit 102 drops, the fit of stem 356 within poppet port 358 is sufficiently tight that fluid from conduit 316 cannot replenish fluid in conduit 102 as quickly as fluid from conduits 102 and 116 can leak out of the wand. Thus, when a leak occurs from the fully kicked off wand, the flow through the poppet chamber causes a pressure drop of perhaps 400 psi across the poppet. That is to say, the coil is pressured to 2,400 psi, but only 2,000 psi gets delivered to the kick-off assembly when the leak occurs. The 2,000 psi still being delivered to the wand is sufficient to keep it kicked over fully and leaking. The tight area between the poppet hole and the stem (that fits into it) will allow for exact pressure signals when no flow to the KO is occurring (coil at 2,400 psi, KO at 2,400 psi). But, when a leak occurs, there is a small pressure drop in the KO to 2,000 psi, and the higher 2,400 psi still exists in the coil. This pressure drop is the pressure required to force fluid past the poppet-stem arrangement. This means that the upper poppet has 2,400 psi acting on it, and the lower poppet assembly has 2,000 psi acting on it.

If the poppet has 2,400 psi on all sides, it moves to the left against the return spring, but if the poppet is acted upon by a higher pressure on the left side than on the right, this pressure difference causes the poppet to return to the right side, not because all pressure to the BHA is lower, but because of the 15 LPM flowing pressure drop through the poppet-stem assembly.

With a lessening of pressure in chamber 342 of poppet 362, poppet 362 is scaled and designed to return to its right position, as illustrated in FIG. 12DD. Fluid pressure now through conduit 316 will be sufficient to retain significant fluid pressure in conduit 102, to compensate the kick-off sub for the leaking, but will be insufficient to provide sufficient pressure in chamber 342 to move poppet 362 against spring 346 to the left. As a result, the sweep sub will cease rotating.

Returning to FIG. 12D, it can be seen that when the kick-off sub is pressured up but not leaking, poppet 362 will assume the left-most position, as illustrated in FIG. 12D. In the left-most position, fluid from conduit 316 not only flows through fluid conduit 102 but also through conduit 344 into conduit 100 and thus into the sweep sub. However, once fluid begins to leak from conduit 102, poppet 362 returns to its right-most position, as illustrated in FIG. 12DD. In its right-most position, sweep sub conduit 100 is no longer pressured through conduit 344 with pressurized fluid. In such state, the sweep sub will stop motion, moving neither to the right or the left. Holding such position, the tubing could be run down into a hole following a fully kicked-out wand into a presumed lateral bore hole.

Either subsequent to running down into a hole following a fully kicked-out wand, or subsequent to a wand making a full sweep without fully kicking out, the kick-out sub and sweep sub can be reset. Returning to the main valve and piston 311 of FIGS. 12C and 12CC, pressuring up conduit 308 to a sufficiently high pressure (3,000 psi) moves piston 311 to the right and ring 332 out of detent 334 and into detent 326. In such position, FIG. 12CC, fluid from conduit 308 no longer flows into conduit 316 but rather flows, as per FIG. 12CC, through port 312 and chamber 318 into circulation fluid conduit 320. As shown in following FIG. 12D, fluid in conduit 320 flows into conduit 104. As shown in FIG. 11A, fluid in conduit 104 flows through conduit chamber 130 and pressures against the left side of sweep sub piston 120, moving piston 120 to the right and resetting the sweep sub. Fluid in sweep sub piston chamber 122 can vent through conduit 114, chamber 112, conduit 100, conduit 344 and out vent 360. Releasing pressure from conduit 316 releases pressure in conduit 102 and conduit 116, resulting in release of pressure in kick-off chamber 144. Compression spring 140 returns kick-off piston 142 to its rest position, illustrated in FIG. 11DD. In the reset position, wand W is in a straight position as illustrated in FIG. 11EE.

Thus, to flow through the tool as well as to reset the sweep, the spring-loaded main detent valve can be opened by exerting high pressure (3,000 psi). By increasing the tubing pressure to a high predetermined value, this valve releases and opens, held down by a second position detent groove. With this valve open, flow through the tool is enabled and tubing pressure to the kick-off sub is significantly lost. The kick-off and sweep pistons return to their original positions, before the kick-sweep-leak function was initiated, the kick-off piston by virtue of its spring bias and the sweep piston by virtue of fluid pressure around the piston OD.

Once the flow rate through the main valve falls below 0.5 BPM the main valve is biased back and closes, thus the reset of the tool is complete. This operation of resetting the tool is easy enough to permit many kick-off/sweep attempts in a short period of time, which is an advantage, as in general there is poor depth correlation when running with coiled tubing.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumption that recitation of a single element covers one or more, and recitation of two elements covers two or more, and the like.

What is claimed is:

1. Apparatus for use in working over a multilateral well by running tubing into a bore of the multilateral well, comprising:

a workover bottom hole assembly (BHA) having at least one remotely activatable, radially deflectable toe, the BHA structured in combination with at least one toe to produce a moment of force remotely activatable in a radial direction sufficient to eccentrically bias the toe outwardly against the bore within at least a predetermined lateral range; and means for sensing a radial outward deflection of a toe.

2. The apparatus of claim 1 wherein the BHA is structured in combination with at least one toe to produce a moment of force in a radial direction of an amount sufficient to deflect the at least one toe vertically against gravity for up to a predetermined distance while of an amount insufficient to significantly deflect the BHA vertically against gravity.

3. The apparatus of claim 1 that includes at least one laterally adjustable toe and wherein the BHA is structured to produce a moment of force in a lateral direction sufficient to laterally adjust the at least one toe.

4. The apparatus of claim 3 wherein the BHA is structured to cease producing a moment of force in the lateral direction upon a radial deflection of a toe beyond a preset amount.

5. The apparatus of claim 3 wherein the BHA is structured in combination with at least one toe to produce a lateral force sufficient to laterally adjust a deflected toe in a circular pattern.

6. The apparatus of claim 5 wherein the lateral force is such that the toe completes a circular revolution in one minute or longer.

7. The apparatus of claim 1 wherein the BHA is in fluid communication with a well surface and the BHA has a port, structured in combination with the BHA and at least one toe to adjust BHA fluid pressure when at least one toe is deflected beyond a predetermined amount.

8. The apparatus of claim 7 that includes at least one laterally adjustable toe and wherein the BHA is structured to produce a moment of force in a lateral direction sufficient to laterally adjust at least one said toe.

9. The apparatus of claim 8 wherein the BHA ceases producing a moment in the lateral direction upon an adjustment in fluid pressure by the port.

10. The apparatus of claim 7 wherein the BHA is attached to one end of coiled tubing and wherein a port adjustment of fluid pressure is communicated to a second end of the coiled at the well surface.

11. The apparatus of claim 7 that includes a well surface pressure detector in fluid communication with the BHA.

12. The apparatus of claim 7 wherein the port alters fluid pressure by leaking.

13. The apparatus of claim 1 wherein an end portion of the BHA comprises a wand carrying a toe.

14. The apparatus of claim 1 wherein the BHA is connected to coiled tubing and that includes means for signaling a toe biased beyond a preselected amount.

15. The apparatus of claim 1 wherein the BHA is hydraulically operated.

16. A workover bottom hole assembly (BHA) for use in working over a multilateral well by running tubing into a bore of a multilateral well, comprising:

at least one wand attached at an end of the BHA, the wand adjustable from a first position aligned with respect to a longitudinal axis of the BHA to a second position non-aligned with respect to the BHA axis;

a kick-off sub attached within the BHA, adapted to bias the at least one wand with a radially outward moment of force to deflect within at least a predetermined lateral range; and means for sensing a radial outward deflection of a wand.

17. The apparatus of claim 16 including a sweep sub attached within the BHA adapted to laterally adjust at least one wand about a BHA longitudinal axis.

18. The apparatus of claim 17 wherein the sweep sub is operated hydraulically.

19. The apparatus of claim 17 wherein the sweep sub is structured in combination with the wand to cease lateral adjustment when the wand assumes at least one position of relative alignment with the BHA.

20. The apparatus of claim 16 wherein the kick-off sub is operated hydraulically.

21. The apparatus of claim 16 wherein the BHA includes a port adapted to hold fluid pressure in at least a first wand relative alignment position with respect to the BHA and to leak fluid pressure in at least a second wand relative alignment position with respect to the BHA.

22. The apparatus of claim 21 including a fluid pressure detecting element in fluid communication with the port.

23. The apparatus of claim 16 wherein the wand has a bull nose and that includes means for signaling when the wand deflects beyond the second position.

24. The apparatus of claim 16 wherein the wand includes lightweight pipe.

25. The apparatus of claim 16 wherein the wand includes a jetting nozzle.

26. The apparatus of claim 16 wherein the wand length is a function of well diameter.

27. A method for use in working over a multilateral well by navigating a bore of the multilateral well, comprising:

running tubing carrying a workover bottom hole assembly (BHA) into the multilateral well;

radially deflecting at least one toe of the BHA to establish biased contact with a bore hole wall;

moving the at least one toe in contact with bore hole wall portions; and sensing eccentrically kicking out the at least one toe.

28. A method of claim 27 wherein moving the at least one toe includes laterally adjusting the toe and that includes signaling eccentrically kicking out the at least one toe.

29. The method of claim 28 that includes ceasing moving the toe laterally if the toe deflects beyond a predetermined amount.

30. The method of claim 27 that includes radially biasing at least one toe such that the toe deflects beyond a predetermined amount only when directed toward an enlarged bore hole space at least in part vertically above the BHA.

31. The method of claim 30 that includes running the tubing to tag bottom subsequent to a toe deflecting beyond a predetermined amount.

32. The method of claim 27 that includes deflecting at least one toe beyond a predetermined amount; deflecting a wand in a radial direction assumed by a toe deflected beyond a predetermined amount; and running the tubing behind the deflected wand into a lateral bore.

33. The method of claim 32 that includes carrying a toe on a wand and whereby deflecting the toe deflects the wand.

34. The method of claim 32 running the tool to the bottom of a bore hole and tagging bottom prior to running the tool in a lateral behind the deflected wand.

35. The method of claim 27 that includes moving a plurality of toes longitudinally along bore hole wall portions.

36. The method of claim 27 that includes adjusting pressurized fluid of the BHA if the toe deflects more than a predetermined amount.

37. The method of claim 27 that includes signaling if a toe deflects beyond a predetermined amount.

38. The method of claim 37 that includes jetting through the toe subsequent to signaling.

39. The method of claim 27 wherein radially deflecting a toe includes radially deflecting a wand carried on an end of a BHA.

40. The method of claim 39 wherein running tubing into a multilateral well includes running at least one toe in a non-radially deflected configuration.

41. The method of claim 27 wherein moving the at least one toe includes laterally adjusting the toe at a rate of at least one minute per revolution.

42. The method of claim 27 wherein moving the toe includes laterally adjusting the toe in a circular patterns.

43. The method of claim 27 wherein running tubing includes running coiled tubing.

44. The method of claim 27 that includes running the tubing in a bore to tag bottom prior to radially deflecting a toe.

45. A bottom hole assembly (BHA) for running tubing into a bore of a multilateral well, comprising:

at least one wand attached at an end of the BHA, the wand adjustable from a first position aligned with respect to a longitudinal axis of the BHA to a second position non-aligned with respect to the BHA axis;

a kick-off sub attached within the BHA, adapted to bias that at least one wand with a radially outward moment of force to deflect within at least a predetermined lateral range;

means for sensing a radial outward deflection of a wand; and a sweep sub attached within the BHA adapted to laterally adjust at least one wand about a BHA longitudinal axis.

46. A bottom hole assembly (BHA) for running tubing into a bore of a multilateral well, comprising:

at least one wand attached at an end of the BHA, the wand adjustable from a first position aligned with respect to a longitudinal axis of the BHA to a second position non-aligned with respect to the BHA axis;

a kick-off sub attached within the BHA, adapted to bias the at least one wand with a radially outward moment of force to deflect within at least a predetermined lateral range; and a sweep sub attached within the BHA adapted to laterally adjust at least one wand about a BHA longitudinal axis, wherein the sweep sub is operated hydraulically.

47. The BHA of claim 46 wherein the BHA includes a port adapted to hold fluid pressure in at least a first wand relative alignment position with respect to the BHA and to leak fluid pressure in at least a second wand relative alignment position with respect to the BHA.

48. The BHA of claim 47 including a fluid pressure detecting element in fluid communication with the port.

49. The BHA of claim 46 wherein the wand has a bull nose.

50. The BHA of claim 46 wherein the wand includes means for signaling when the wand deflects beyond the second position.

51. The BHA of claim 46 wherein the sweep sub is structured in combination with the wand to cease lateral adjustment when the wand assumes at least one position of relative alignment with the BHA.

52. The BHA of claim 46 wherein the wand includes lightweight pipe.

53. The BHA of claim 46 wherein the wand further comprises a toe.

54. The BHA of claim 46 wherein the wand further comprises a jetting nozzle.

55. The BHA of claim 46 wherein the wand length is a function of well diameter.

56. A bottom hole assembly (BHA) for running tubing into a bore of a multilateral well, comprising:

at least one wand attached at an end of the BHA, the wand adjustable from a first position aligned with respect to a longitudinal axis of the BHA to a second position non-aligned with respect to the BHA axis;

a kick-off sub attached within the BHA, adapted to bias the at least one wand with a radially outward moment of force to deflect within at least a predetermined lateral range;

means for sensing a radial outward deflection of a wand; and a sweep sub attached within the BHA adapted to laterally adjust at least one wand about a BHA longitudinal axis, wherein the sweep sub is structured in combination with the wand to cease lateral adjustment when the wand assumes at least one position of relative alignment with the BHA.

57. The method for navigating a bore of a multilateral well, comprising:

running tubing carrying a bottom hole assembly (BHA) into a multilateral well;

radially deflecting at least one toe of the BHA to establish biased contact with a bore hole wall;

moving the at least one toe in contact with bore hole wall portions;

sensing eccentrically kicking out the at least one toe; and radially biasing at least one toe such that the toe deflects beyond a predetermined amount only when directed toward an enlarged bore hole space at least in part vertically above the BHA.

58. A method for navigating a bore of a multilateral well, comprising:

running tubing carrying a bottom hole assembly (BHA) into a multilateral well;

radially deflecting at least one toe of the BHA to establish biased contact with a bore hole wall moving the at least one toe in contact with bore hole wall portions;

eccentrically kicking out the at least one toe;

deflecting at least one toe beyond a predetermined amount;

deflecting a wand in a radial direction assumed by a toe deflected beyond a predetermined amount;

running the tubing behind the deflected wand into a lateral bore; and running the tool to the bottom of a bore hole and tagging bottom prior to running the tool in a lateral behind the deflected wand.

59. A method for navigating a bore of a multilateral well, comprising;

running tubing carrying a bottom hole assembly (BHA) into a multilateral well;

radially deflecting at least one toe of the BHA to establish biased contact with a bore hole wall;

moving the at least one toe in contact with bore hole wall portions;

eccentrically kicking out the at least one toe; and moving a plurality of toes longitudinally along bore hole wall portions.

60. The method of claim 59 that includes adjusting pressurized fluid of the BHA if a toe deflects more than a predetermined amount.

61. The method of claim 59 that includes signaling if a toe deflects beyond a predetermined amount.

62. The method of claim 59 that includes jetting through the toe subsequent to signaling.

63. The method of claim 59 that wherein moving at least one toe includes laterally adjusting the toe; and ceasing moving the toe laterally if the toe deflects beyond a predetermined amount.

64. The method of claim 59 wherein radially deflecting a toe includes radially deflecting a wand carried on an end of a BHA.

65. The method of claim 59 wherein moving the at least one toe includes laterally adjusting the toe rate of at least one minute per revolution.

66. The method of claim 59 that includes laterally adjusting the toe in a circular patterns.

67. The method of claim 59 wherein running tubing into a multilateral well includes running at least one toe in a non-radially deflected configuration.

68. The method of claim 59 wherein running tubing includes running coiled tubing.

69. The method of claim 59 further including running the tubing in a bore to tag bottom prior to radially deflecting a toe.

70. The method of claim 59 further wherein moving the at least one toe includes laterally adjusting the toe and that includes signaling eccentrically kicking out the at least one toe.

71. The method of claim 59 that includes radially biasing at least one toe such that the toe deflects beyond a predetermined amount only when directed toward an enlarged bore hole space at least in part vertically above the BHA.

72. A method for navigating a bore of a multilateral well, comprising:

running tubing carrying a bottom hole assembly (BHA) into a multilateral well;

radially deflecting at least one toe of the BHA to establish biased contact with a bore hole wall;

moving the at least one toe in contact with bore hole wall portions;

eccentrically kicking out the at least one toe;

radially biasing at least one toe such that the toe deflects beyond a predetermined amount only when directed toward an enlarged bore hole space at least in part vertically above the BHA; and running the tubing to tag bottom subsequent to a toe deflecting beyond a predetermined amount.

73. A method for navigating a bore of a multilateral well, comprising:

running tubing carrying a bottom hole assembly (BHA) into a multilateral well;

radially deflecting at least one toe of the BHA to establish biased contact with a bore hole wall, wherein radially deflecting a toe includes radially deflecting a wand carried on an end of the BHA;

moving the at least one toe in contact with bore hole wall portions; and sensing eccentrically kicking out the at least one toe, wherein running tubing into a multilateral well includes running at least one toe in a non-radially deflected configuration.

* * * * *